US009770623B2

(12) United States Patent
Ellis

(10) Patent No.: US 9,770,623 B2
(45) Date of Patent: Sep. 26, 2017

(54) UPPER AND LOWER BODY PRESS EXERCISE MACHINE

(71) Applicant: Joseph K. Ellis, Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 14/564,974

(22) Filed: Dec. 9, 2014

(65) Prior Publication Data

US 2015/0151158 A1 Jun. 4, 2015

Related U.S. Application Data

(63) Continuation-in-part of application No. 14/207,020, filed on Mar. 12, 2014, which is a (Continued)

(51) Int. Cl.
*A63B 21/00* (2006.01)
*A63B 21/068* (2006.01)

(Continued)

(52) U.S. Cl.
CPC .... *A63B 23/0205* (2013.01); *A63B 21/00069* (2013.01); *A63B 21/00181* (2013.01); *A63B 21/068* (2013.01); *A63B 21/0615* (2013.01); *A63B 21/159* (2013.01); *A63B 21/4033* (2015.10); *A63B 21/4047* (2015.10); *A63B 21/4049* (2015.10); *A63B 22/205* (2013.01); *A63B 23/0222* (2013.01); *A63B 23/0227* (2013.01); *A63B 23/03525* (2013.01); *A63B 21/008* (2013.01); *A63B 21/0085* (2013.01);

(Continued)

(58) Field of Classification Search
CPC ..... A63B 21/0615; A63B 21/0617; A63B 21/4045; A63B 22/20; A63B 22/201; A63B 22/203; A63B 2022/0084; A63B 23/0205; A63B 23/0222; A63B 23/03583; A63B 23/035; A63B 23/02; A63B 23/0233; A63B 22/06; A63B 22/16; A63B 22/205; A63B 2022/206; A63B 23/0227; A63B 21/0616; A63B 21/068; A63B 23/025; A63B 23/03575; A63B 22/208
See application file for complete search history.

(56) References Cited

U.S. PATENT DOCUMENTS 3,235,255 A * 2/1966 Leflar ..... A63B 21/0724 482/104
3,589,720 A * 6/1971 Agamian ..... A63B 21/012 310/69

(Continued)

*Primary Examiner* — Stephen R Crow
*Assistant Examiner* — Nyca T Nguyen
(74) *Attorney, Agent, or Firm* — Laurence P. Colton; Smith Tempel Blaha LLC

(57) ABSTRACT

A machine for concurrently or independently performing pressing motions with the hands and feet, the machine having a base having front and back ends, two or more linear slide rails, a lower body user support with an engagement means for the user's feet and an upper body user support with an engagement means for the user's hands. The upper body user support and lower body user support slide on the linear rails that are located proximally on opposing ends of the base frame and the upper body user supports and the lower body user supports cooperate with one another to move in opposing converging and diverging sloping linear movement patterns during operation of the machine.

7 Claims, 12 Drawing Sheets

Related U.S. Application Data continuation-in-part of application No. 14/148,303, filed on Jan. 6, 2014, which is a continuation-in-part of application No. 13/967,188, filed on Aug. 14, 2013, now Pat. No. 8,888,661, which is a continuation-in-part of application No. 13/992,744, filed as application No. PCT/US2011/065738 on Dec. 19, 2011.

(51) Int. Cl.

| | |
|---|---|
| ***A63B 21/08*** | (2006.01) |
| ***A63B 23/02*** | (2006.01) |
| ***A63B 21/06*** | (2006.01) |
| ***A63B 22/20*** | (2006.01) |
| ***A63B 23/035*** | (2006.01) |
| *A63B 21/008* | (2006.01) |
| *A63B 21/012* | (2006.01) |
| *A63B 21/02* | (2006.01) |
| *A63B 22/14* | (2006.01) |
| *A63B 21/062* | (2006.01) |

(52) U.S. Cl.

CPC ..... *A63B 21/012* (2013.01); *A63B 21/02* (2013.01); *A63B 21/0628* (2015.10); *A63B 21/4035* (2015.10); *A63B 22/14* (2013.01); *A63B 2208/0219* (2013.01); *A63B 2225/09* (2013.01)

(56) References Cited

U.S. PATENT DOCUMENTS

| | | | | |
|---|---|---|---|---|
| 4,743,010 | A * | 5/1988 | Geraci | A63B 22/0076 482/72 |
| 5,224,909 | A * | 7/1993 | Hamilton | A63B 21/154 482/51 |
| 5,518,483 | A * | 5/1996 | Oswald | A63B 21/012 482/114 |
| 5,554,086 | A | 9/1996 | Habing | |
| 6,264,588 | B1 | 7/2001 | Ellis | |
| 6,287,241 | B1 | 9/2001 | Ellis | |
| 7,220,221 | B2 | 5/2007 | Mosimann | |
| 7,232,404 | B2 | 6/2007 | Nelson | |
| 7,335,140 | B2 | 2/2008 | Webber | |
| 7,455,633 | B2 | 11/2008 | Brown | |
| 7,585,263 | B2 | 9/2009 | Brown | |
| 7,594,880 | B2 | 9/2009 | Webber | |
| 7,611,446 | B2 | 11/2009 | Chuang | |
| 7,651,446 | B1 | 1/2010 | Eschenbach | |
| 7,662,076 | B1 | 2/2010 | Ho | |
| 7,727,128 | B2 | 6/2010 | Giannelli | |
| 7,731,638 | B2 | 6/2010 | Webber | |
| 7,867,149 | B1 | 1/2011 | Webber | |
| 7,963,890 | B2 | 6/2011 | Webber | |
| 8,162,807 | B1 | 4/2012 | Webber | |
| 8,172,732 | B1 | 5/2012 | Webber | |
| 8,317,665 | B2 | 11/2012 | Webber | |
| 8,888,661 | B2 | 11/2014 | Ellis | |
| 2010/0048367 | A1* | 2/2010 | Liang | A63B 21/154 482/130 |
| 2011/0028283 | A1 | 2/2011 | Webber | |

* cited by examiner

UPPER AND LOWER BODY PRESS EXERCISE MACHINE

STATEMENT OF RELATED APPLICATIONS

This patent application claims the benefit of pending U.S. patent application Ser. No. 14/207,020 having a filing date of 12 Mar. 2014, which claims the benefit of pending U.S. patent application Ser. No. 14/148,303 having a filing date of 6 Jan. 2014, which claims the benefit of U.S. patent application Ser. No. 13/967,188 having a filing date of 14 Aug. 2013, now U.S. Pat. No. 8,888,661 having an issue date of 18 Nov. 2014, which claims the benefit of pending U.S. patent application Ser. No. 13/992,744 having a filing date of 9 Jun. 2013, which claims the benefit of expired International Application No. PCT/US2011/065738 having an international filing date of 19 Dec. 2011.

BACKGROUND OF THE INVENTION

Technical Field

This invention relates to the general technical field of exercise, physical fitness and physical therapy equipment and machines. This invention relates more specifically to the field of exercise equipment for concurrently exercising the user's upper and lower body in one exercise motion.

Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on specific areas or muscle groups of the body such as the legs, the hips and lower torso, the chest and upper torso, the back, the shoulders and the arms. The operations of these machines generally concentrate on a single muscle group such as biceps, pectorals, quadriceps and so forth. Other equipment and machines are designed to aid the user in the exercise regimen, such as to aid the elderly, handicapped, and/or infirm in an appropriate exercise regimen. There are numerous examples each of these different types of exercise equipment and machines.

Generally, such equipment and machines can be categorized into three broad categories: free weights, mechanically operated single action resistance machines, and electrically operated resistance machines. Mechanically operated single action resistance machines can be subcategorized into three broad categories: stack weight resistance operated, free weight resistance operated, and alternative resistance operated. Mechanically operated single action resistance machines are available for exercising, strengthening and rehabilitating various individual muscles, muscle groups, combinations of muscle groups, joints, and other parts of the body.

This inventor previously has developed a composite motion movement machine for use in connection with exercise and physical therapy equipment. U.S. Pat. No. 6,264,588 discloses this composite motion movement machine, which combines a moving actuating member and a moving user support, the composite motion movement machine having a support member, a frame on which the user support is located, the frame being pivotably connected to the support member, a truck in slidable engagement with the support member and the frame, an actuating member being pivotably connected to the support member and operatively connected to the truck, the actuating member being adapted to move between a first position and a second position, and a linking mechanism operatively connecting said actuating member with said truck, wherein, when the user moves the actuating member between the first position and the second position, the truck moves along rails on the support member, forcing the frame to pivot relative to the support member and causing the user to actuate a resistance weight, thus exercising, strengthening or rehabilitating certain of the user's muscles. This machine can be used in connection with a variety of different resistance or assistance mechanism, such as stack weights, free weights, and alternative weight resistance devices.

U.S. Pat. No. 8,888,661 discloses this inventor's improvement on abdominal and core exercise apparatuses by utilizing a centrally pivoting linkage member that is operatively attached on a first end to a pivoting upper body actuating member and operatively attached on an opposite second end to a sliding while pivoting user support. When the user pulls the upper body actuating member towards the user support, this causes the first end of the centrally pivoting linkage member to move downward and causes the opposite second end of the centrally pivoting linkage member to move upward, thus causing the sliding while pivoting user support to move in a direction towards the pivoting upper body actuating member with the user support pivoting upwardly from back to front. This causes the user's upper and lower extremities to be in an extended position in the first position of the exercise and in a contracted position in the second position of the exercise, thus causing certain muscles of the user's abdominals and core portion of the torso to be exercised. This machine can be used in connection with a variety of different resistance or assistance mechanisms, such as stack weights, free weights, and alternative weight resistance devices.

U.S. Pat. No. 6,287,241 discloses this inventor's improvement on leg press exercise apparatuses by utilizing composite motion movement combined with a moving actuating member and a moving user support, the leg press having a support member, a frame on which the user support is located, the frame being pivotably connected to the support member, a truck in slidable engagement with the support member and the frame, an actuating member on which a push plate is located, the actuating member being pivotably connected to the support member and operatively connected to the truck, the actuating member being adapted to move between a first position and a second position, and a linking mechanism operatively connecting the actuating member the truck, wherein, when the user pushes the actuating member between the first position and the second position, the truck moves along rails on the support member, forcing the frame to pivot relative to the support member and causing the user to actuate a resistance weight, thus exercising certain of the user's muscles. This machine can be used in connection with a variety of different resistance or assistance mechanism, such as stack weights, free weights, and alternative weight resistance devices.

U.S. Pat. Nos. 7,232,404, 7,455,633, 7,585,263, and 7,611,446 disclose abdominal exercise machines and/or methods. U.S. Pat. No. 7,651,446 discloses an elliptical core cycle exercise apparatus. U.S. Pat. Nos. 7,662,076, 8,172,732, 8,317,665, 8,162,807, 7,963,890, 7,731,638, and 7,594,880 disclose exercise machines. U.S. Pat. No. 7,867,149 discloses a swiveling user support assembly. U.S. Pat. No. 7,335,140 discloses a triceps dip exercise machine. US Patent Publication No. 20110028283 discloses an exercise machine. U.S. Pat. Nos. 5,554,086, 7,220,221, and 7,727,128 disclose various types of leg press machines.

Current exercise machines generally only allow the user to move in one plane of motion and concentrate the exercise on one set of muscles. However, many people would prefer to exercise concurrently in multiple planes of motion. Such a machine would provide a more safe and effective workout. Moreover, exercising an upper body set of muscles concurrently with a lower body set of muscles through multiple planes of motion would be even more desirable and beneficial. Thus it can be seen that an exercise machine that allows the exercising in at least two planes of motion concurrently and optionally exercising two or more muscle groups concurrently would be useful, novel and not obvious, and a significant improvement over the prior art. It is to such a machine that the current invention is directed.

BRIEF SUMMARY OF THE INVENTION

The present invention provides a safer and more efficient method of a pushing exercise that imitates natural human motion by jointly leveraging the user's upper and lower body to concurrently push against one or more resistance mechanism or mechanisms. While the user's upper body and lower body push in generally opposite directions for this invention, they can move in the same or different planes of motion. The invention can be presented in various embodiments with the common feature of all the embodiments being that the user's upper and lower body exercise simultaneously by pushing linear sliding handles and or platforms away from one another or in a diverging pattern from one another to move the user's body from a first position where the upper and lower extremities are in a more contracted position to a second position where the users upper and lower extremities are in a more extended position. In some embodiments, it is beneficial to the exerciser for the upper body pushing member to comprise two separate handles to be located a greater distant from one another in the first more contracted extremities position and converge to a lesser distance location in the second more extended extremities position. Another feature common to all embodiments of the invention is that at least one of the upper extremities sliding members and at least one of the lower extremities sliding members are operatively connected such that any movement of the at least one of the upper extremities sliding member causes a simultaneous movement of at least one of the lower extremities sliding members and any movement of at least one of the lower extremities sliding members causes a simultaneous movement of at least one of the upper extremities sliding members.

Concurrent upper and lower body exercises are very beneficial forms of exercising to increase strength and flexibility of the major muscle groups as well as the connecting tendons and ligaments of the joints, such as knees, hips, ankles, neck, elbows, and shoulders. Most everyday human physical activities involve movement of multiple joints concurrently with engagement of multiple muscle groups causing a person to go through multiple planes of motion. Therefore, multiple planes of motion exercise will better condition the body to perform the way it naturally moves. Moreover, combining upper and lower body motions into one exercise offers even more benefits as the user is able to leverage their entire body against a resistance force like they would naturally. Before this inventor's inventions of concurrent training multi-dimensional exercise machines, physical fitness and rehabilitation regimens have consisted of free form movements of uncontrolled objects such as barbells, dumbbells, tires, and sleds. These are means of exercising that require advanced skill and knowledge to be performed correctly and safely. This type of exercising also generally requires well above average physical capabilities. The present invention supports and locates the user's body throughout the entire range of multi-dimensional motion of the exercise movement, which allows people of ordinary skill, knowledge, and physical capabilities to perform more effective exercises safely.

All of the preferred embodiments of the invention allow the user to add additional resistance or assistance to the exercise. This includes utilizing free weights that can be directly loaded onto the user support, user engagement means, or linkage mechanism. This also includes utilizing multiple resistance or assistance means that can be connected to the user support, user engagement means, or linkage mechanism, such as weight stacks, hydraulics, pneumatics, springs, elastic bands, magnetic devices, friction brakes, moment arms, and the like.

The invention comprises a stationary base supporting one or more linear slide rails. The rails support two or more linear slidable or rolling members. The slidable members slide on bearings or bushings or the like. The rails also can support wheels that roll on top of the rail or roll inside the rail or are a connected set of wheels that capture the rail by rolling on opposing or multiple sides of the rail. The slidable members are of sufficient size and strength to support a human user as well as any additional weight or resistance that may be added to the exercise regimen.

The invention also comprises a lower body user support that is rigidly attached to a first slidable member. The slidable lower body user support, which preferably is slidable, is a kneeling pad sufficient in size to support at least a portion of the user's lower extremities. The lower body user support also comprises a pressing bar or platform for the user's feet to press against during the exercise regimen. The invention further comprises an upper body user support that is rigidly attached to a second slidable member. The upper body user support contains one or more pressing handles for the user to grip and press during the exercise regimen. The first slidable lower body user support and the second slidable upper body user support are operatively connected such that the upper and lower extremities work in unison during the exercise regimen.

In certain embodiments the lower body user support is one rigid slidable member and the upper body user support is one rigid slidable member. In this embodiment the upper and lower body user supports are operatively connected such that both of the user's arms and both of the user's legs work dependently and in unison against one common resistance.

In another embodiment the slidable lower body user support is two separate members, one for each of the user's legs, that operate independently of one another, and the slidable upper body user supports is two separate members that also operate independently of one another. In this embodiment one of the slidable separate lower body user support members is operatively connected to one of the slidable separate upper body user support members, and the other of the slidable separate lower body user support members is operatively connected to the other of the slidable separate upper body user support members such that the user can press and slide one pair of upper and lower extremities independently of the other pair of upper and lower extremities. In this embodiment there also may be a lever or mechanical device that can be engaged such that the two pairs of actuating slidable members operate dependently of one another or can be disengaged such that the two pairs of slidable actuating members operate independently of one another.

In another embodiment of the invention where there are two slidable separate lower body user support members and two slidable separate upper body user support members, each of which operate independently of each other but are operatively connected to a common resistance mechanism such that any of the four of the user support members can be operated independently to work against the resistance mechanism while the others stay in the at rest position. Alternatively, any combination of two, three, or four of the independent user support members can be operated simultaneously to work against the common resistance mechanism.

In certain embodiments where there are two separate slidable lower body user supports, those two supports can slide in a parallel movement pattern. In other embodiments where there are two separate lower body user supports, those supports can slide in a diverging and reciprocating converging movement pattern.

In certain embodiments where there are two separate sliding upper body user supports, those two supports can slide in a parallel movement pattern. In other embodiments where there are two separate upper body user supports, those supports can slide in a converging and reciprocating diverging path movement pattern.

In certain embodiments the user can adjust the at rest starting position of either the slidable upper body user support member or members or the slidable lower body user support member or members or all user support pushing members so as to accommodate users of various sizes and physical capabilities or to effect the desired function.

These features, and other features and advantages of the present invention, will become more apparent to those of ordinary skill in the art when the following detailed description of the preferred embodiments is read in conjunction with the appended figures in which like reference numerals designate like elements throughout the several views.

BRIEF DESCRIPTION OF THE DRAWINGS

The figures most often show the embodiments of the invention from one side. For the most part, the invention looks the same, but in a mirror image, from the opposite side, with both sides having similar structures, features, and components.

DETAILED DESCRIPTION OF PREFERRED EMBODIMENTS

Exemplary preferred embodiments are disclosed below in connection with the attached drawings. Throughout this specification, various terms will be used to describe various elements or sets of elements, features or sets of features, and devices or sets of devices. For example, the term user support or slidable user support will be used to describe any bar, handle, pad, platform or other elements that the user engages during operation of the machine. The terms at rest, unactivated, and starting positions will be used to describe when the user is not engaging the device, or only minimally so. The terms activated, extended, and operating will be used to describe when the user is engaging the device. The term releasing or releases will be used to describe the user's action during operation of the machine when they are reducing or lessening their exertion force upon the user engagement means. The terms push, pushing, press, or pressing when referring to the user operating the machine, will be used to describe any motion or movement by a user when they are maintaining or increasing their exertion force. The term upper body will refer generally to the user's arms and hands but may also refer to the user's chest, back, and torso as well. The term lower body will generally refer to the user's legs and feet but may also refer to the user's buttocks and hips as well.

FIGS. 1-12 are all views of an embodiment of the invention this inventor terms a total body press machine. Generally, the invention is a machine for concurrently exercising one or more of a user's muscle groups, the machine having a base having front and back ends, two or more linear slide rails, two or more user supports, and engagement members for the user's lower and upper body. The slidable user supports are operatively connected in various configurations and in some embodiments the activation by the user of one or more of the user support engagement means will engage and act upon one or more of the other user support engagement means. Though the slidable user supports are operatively connected in preferred embodiments of the invention, in some embodiments the activation by the user of one or more of the user support engagement means will not engage and act upon the other user support engagement means. The user support can be caused to move by the engagement member being acted upon by the user's feet only, by the user's hands only, or a combination of the user's feet and hands concurrently during the exercise.

Figure 1:
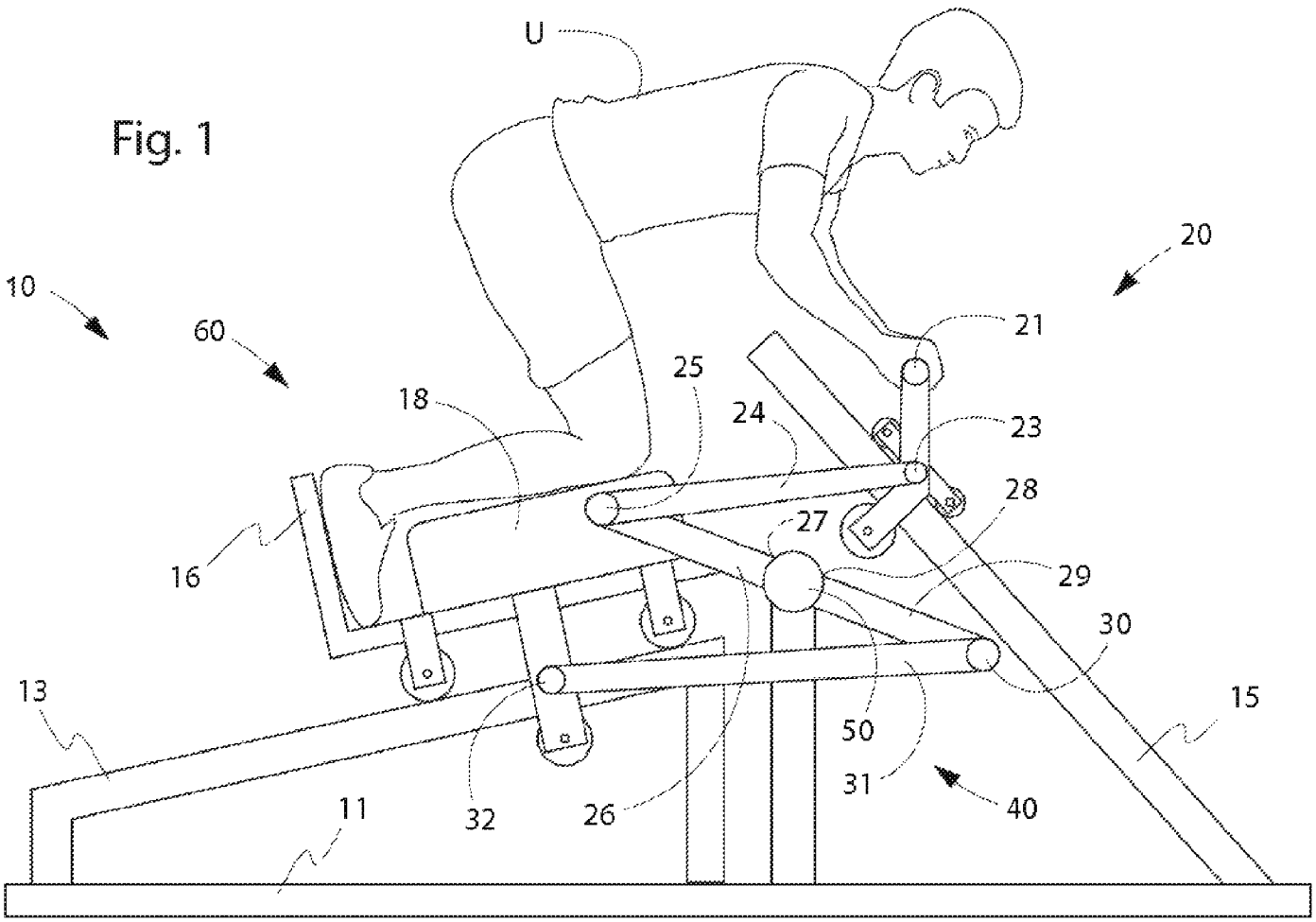
FIG. 1 is a side view of a first embodiment of the invention in the at rest and unactivated position showing a user mounted on the machine that is a combination of a slidable lower body user support and a slidable upper body user support operatively connected via a multi-link linkage system that is rotatable around a rotatable central axle.
Figure 2:
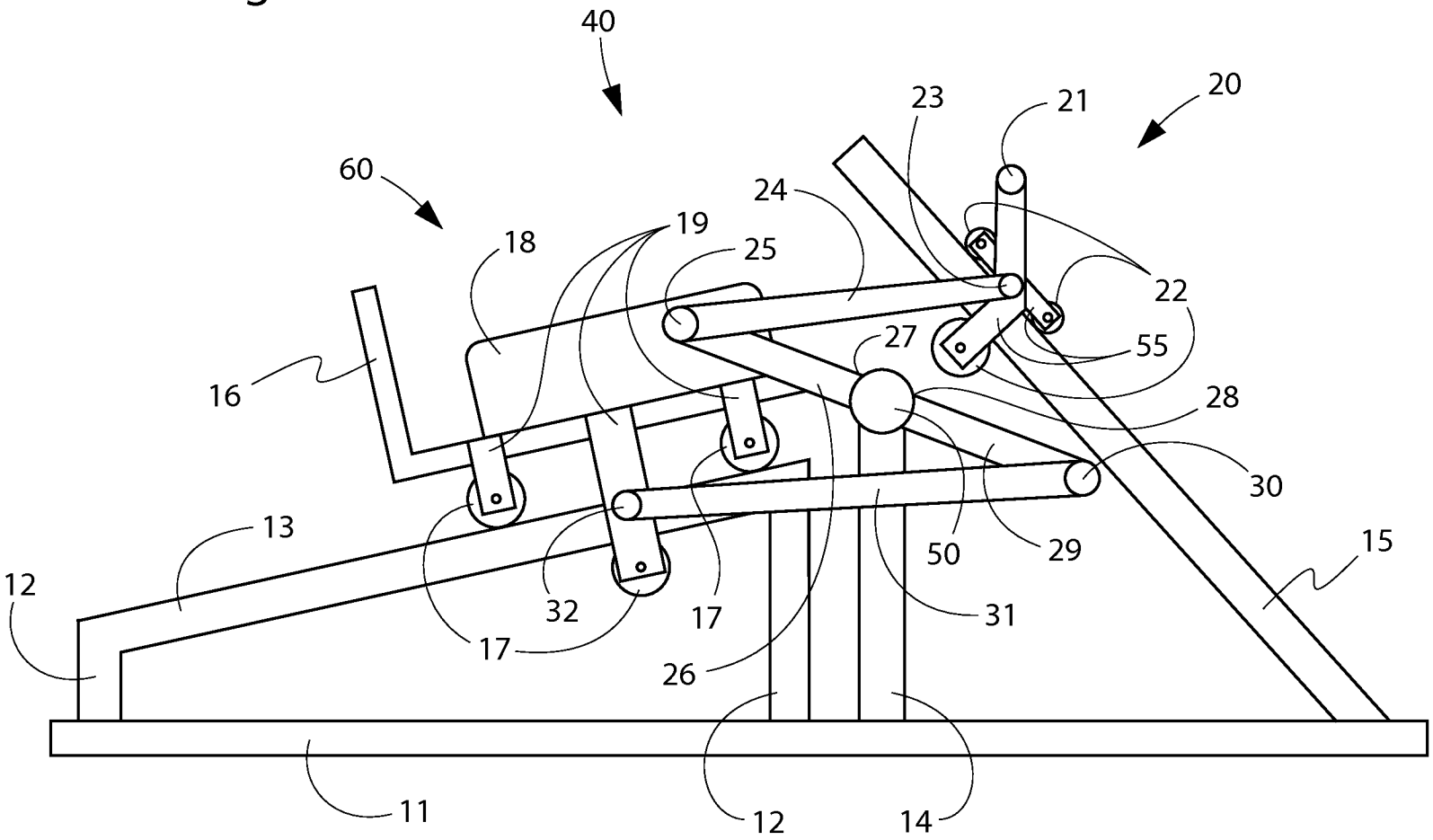
FIG. 2 is a side view of a first embodiment of the invention in the at rest and unactivated position showing a combination of a slidable lower body user support and a slidable upper body user support operatively connected via multi-link linkage system that is rotatable around a rotatable central axle.
Figure 3:
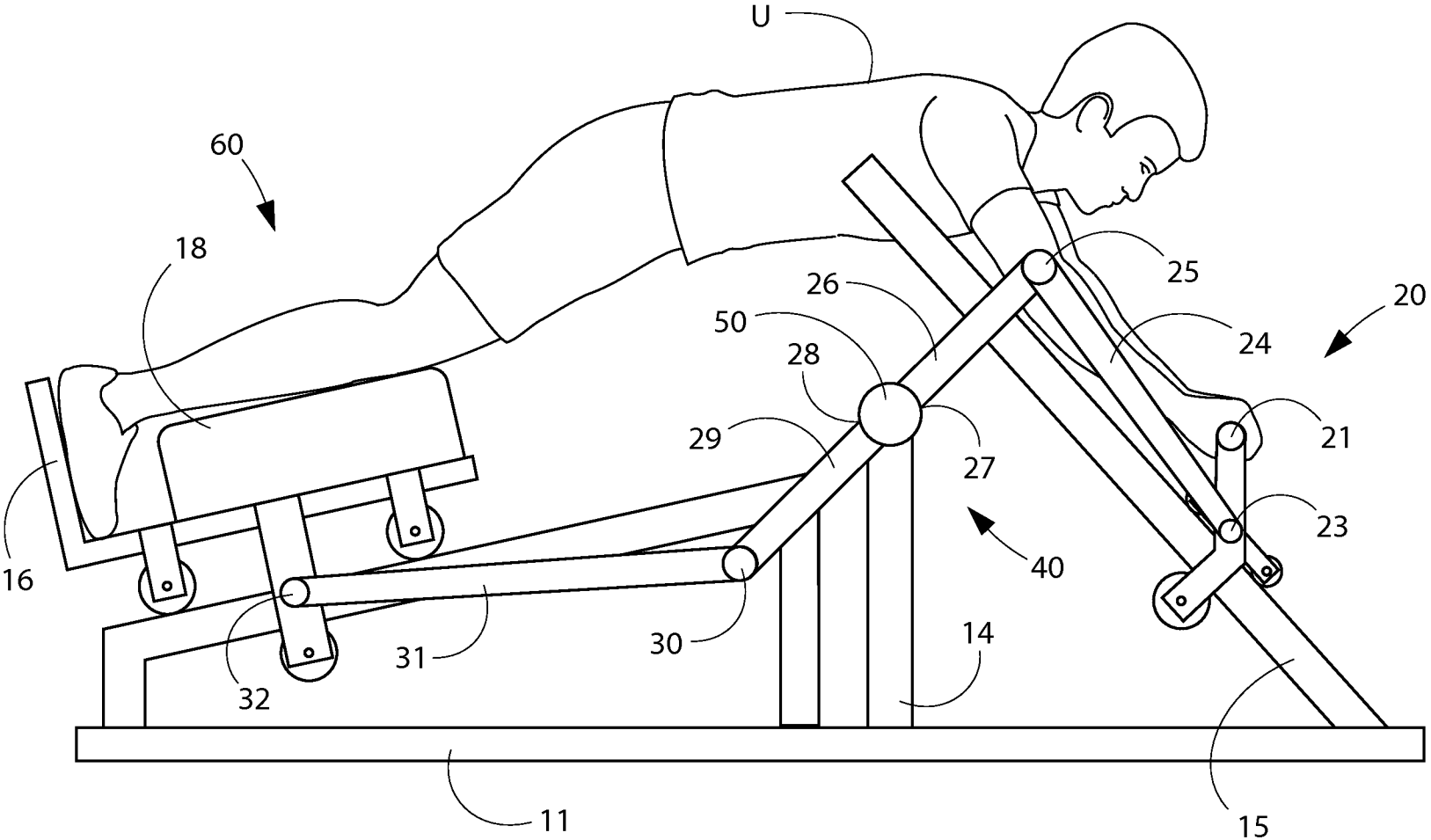
FIG. 3 is a side view of a first embodiment of the invention in the extended and activated position showing a user mounted on the machine that is a combination of a slidable lower body user support and a slidable upper body user support operatively connected via multi-link linkage system that is rotatable around a rotatable central axle.
Figure 4:
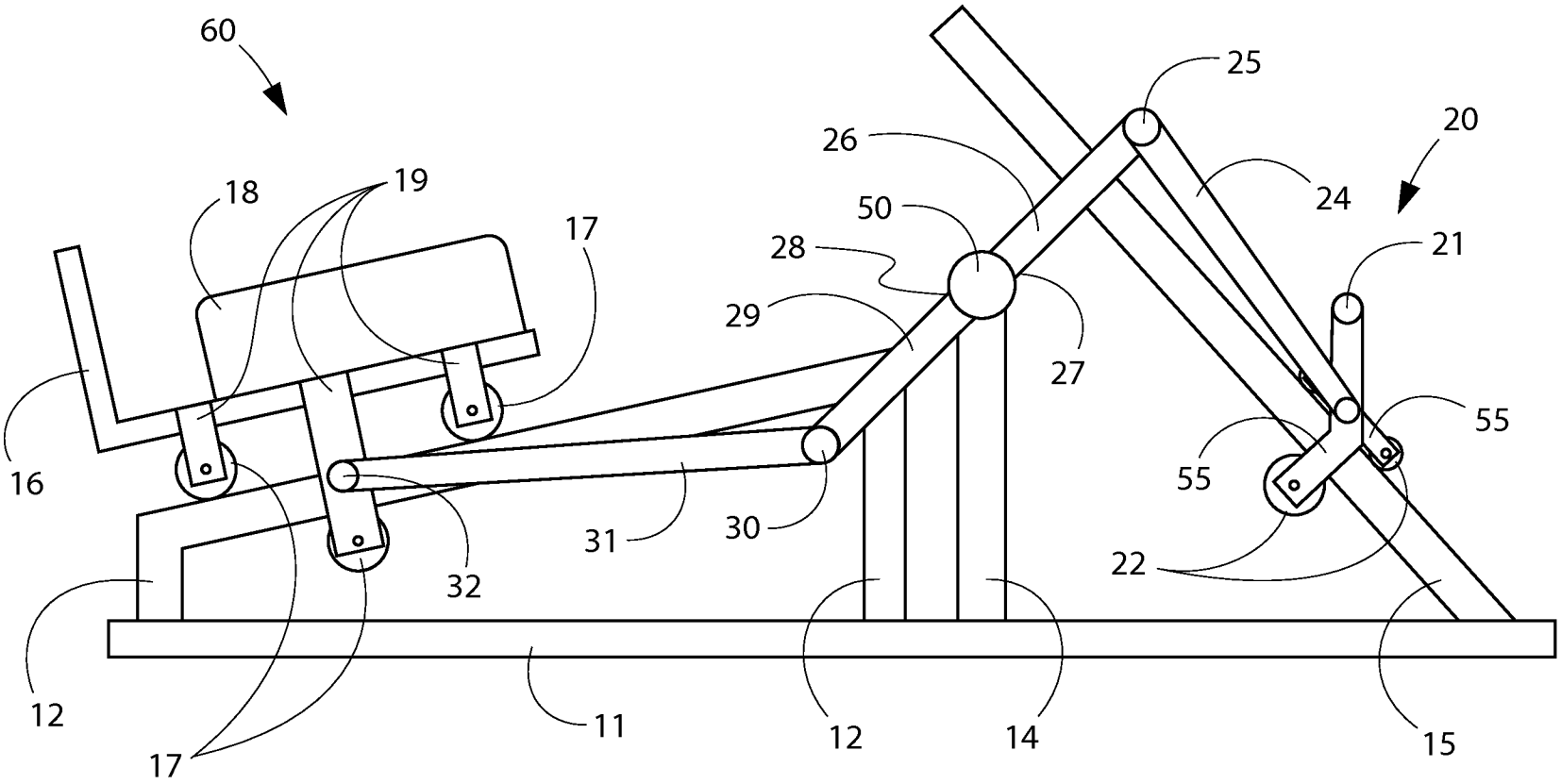
FIG. 4 is a side view of a first embodiment of the invention in the extended and activated position showing is a combination of a slidable lower body user support and a slidable upper body user support operatively connected via multi-link linkage system that is rotatable around a rotatable central axle.

FIG. 1 is a side view of a first embodiment with a user mounted on the machine in the at rest position illustrating the slidable upper and lower body user supports operatively connected via a multi-link linkage system that is rotatable around a rotatable central axle. FIG. 2 is a side view of this first embodiment in the at rest position illustrating the slidable upper and lower body user supports operatively connected via a multi-link linkage system that is rotatable around a rotatable central axle in the at rest position. FIG. 3 is a side view of this first embodiment with a user mounted on the machine in the activated position illustrating the slidable upper and lower body user supports operatively connected via a multi-link linkage system that is rotatable around a rotatable central axle. FIG. 4 is a side view of this first embodiment with the machine in the activated position illustrating the slidable upper and lower body user supports operatively connected via a multi-link linkage system that is rotatable around a rotatable central axle.

Figure 5:
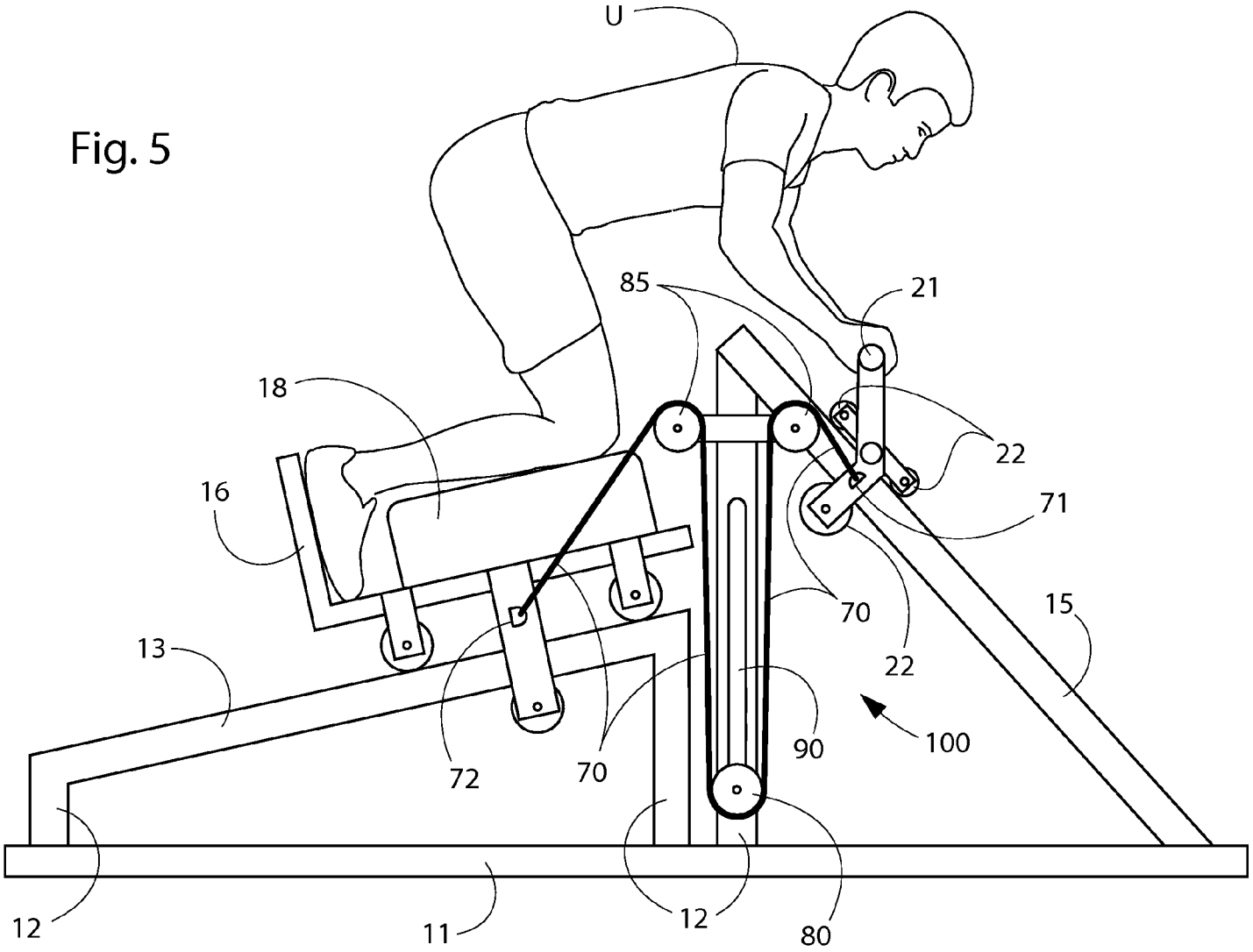
FIG. 5 is a side view of a second embodiment of the invention in the at rest and unactivated position showing a user mounted on the machine configured as a combination of a slidable lower body user support and a slidable upper body user support operatively connected via a two-cable and multiple pulley system.
Figure 6:
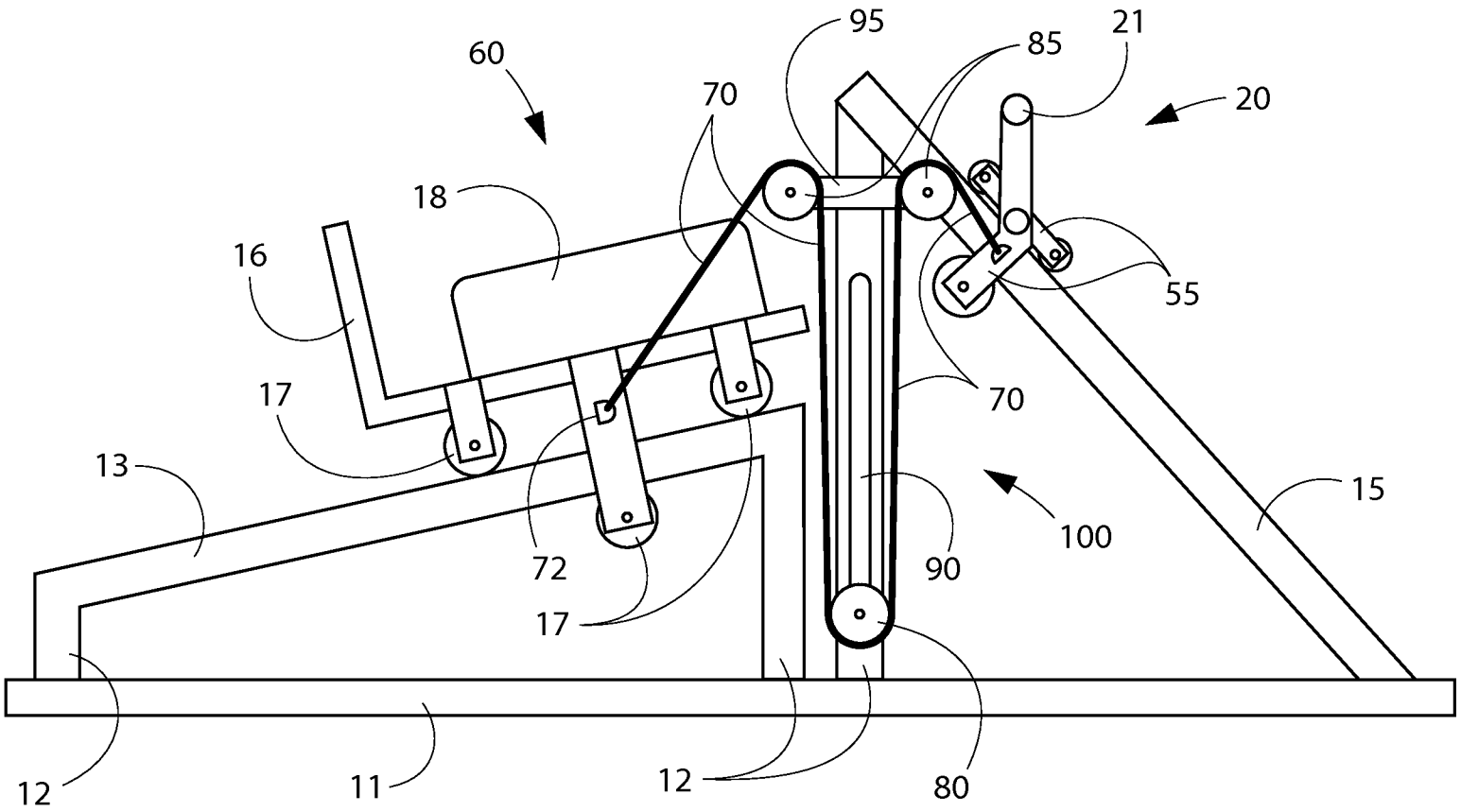
FIG. 6 is a side view of a second embodiment of the invention in the at rest and unactivated position configured as a combination of a slidable lower body user support and a slidable upper body user support operatively connected via a two-cable and multiple pulley system.
Figure 7:
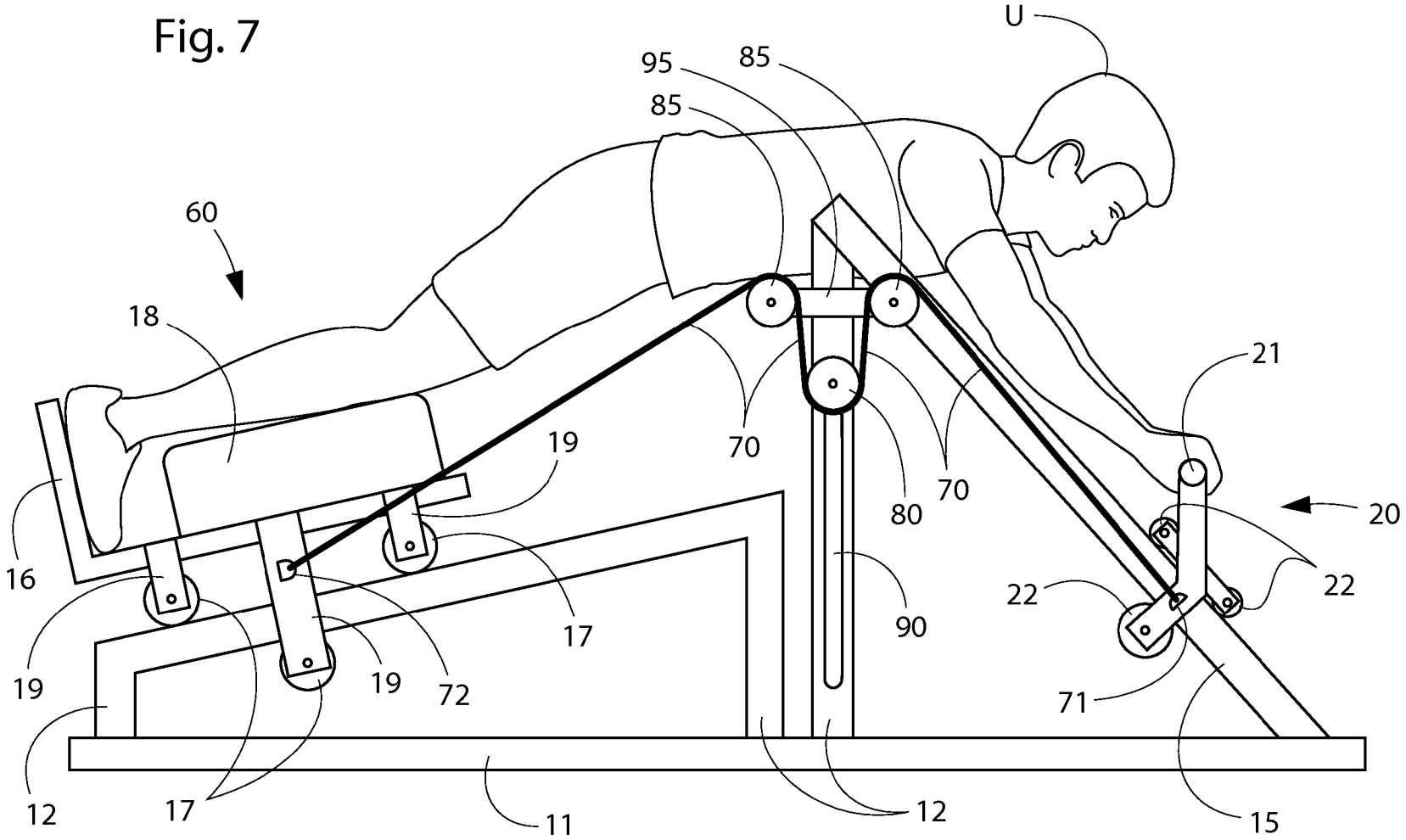
FIG. 7 is a side view of a second embodiment of the invention in the extended and activated position showing a user mounted on the machine configured as a combination of a slidable lower body user support and a slidable upper body user support operatively connected via a two-cable and multiple pulley system.
Figure 8:
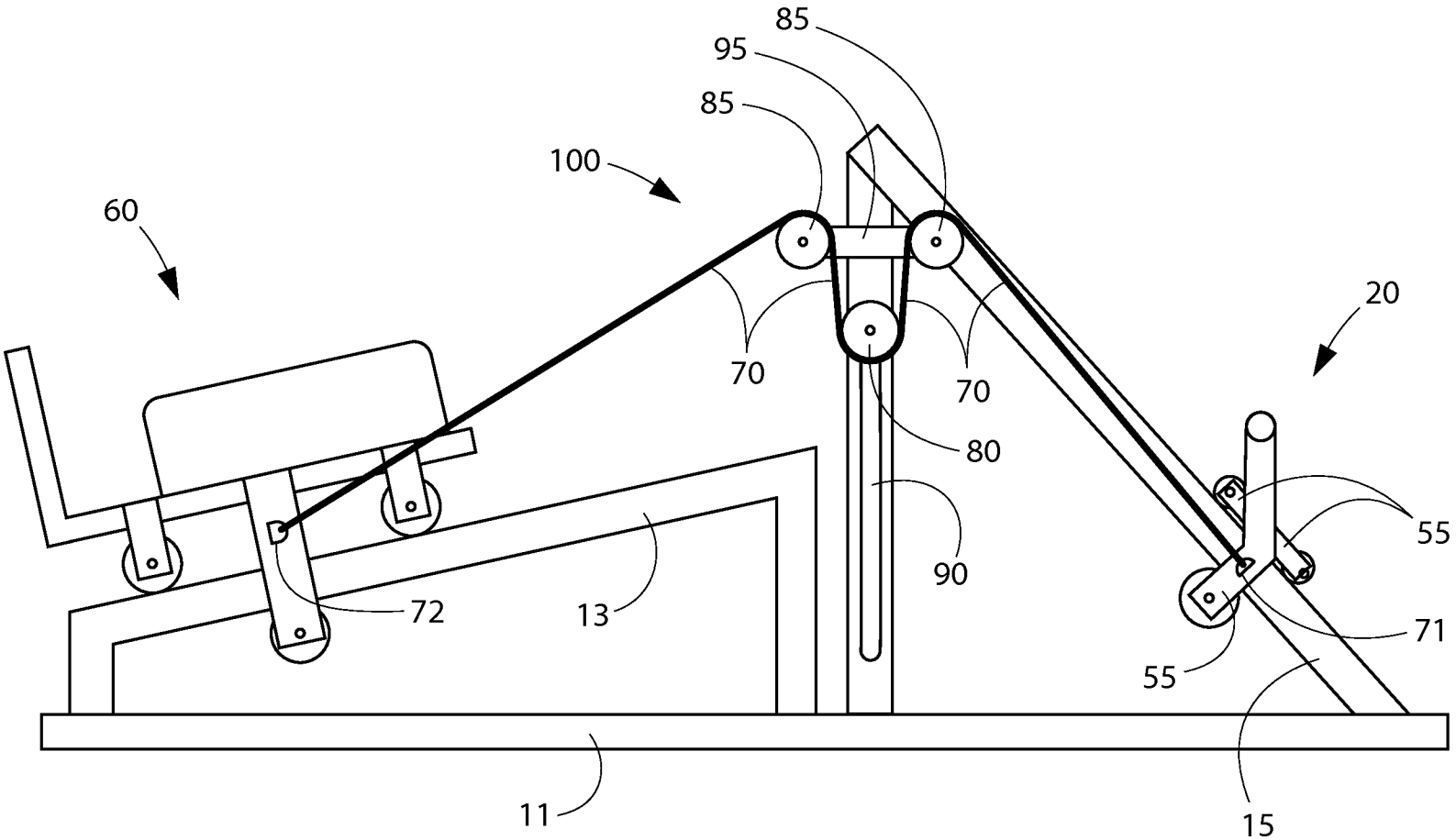
FIG. 8 is a side view of a second embodiment of the invention in the extended and activated position configured as a combination of a slidable lower body user support and a slidable upper body user support operatively connected via a two-cable and multiple pulley system.

FIG. 5 is a side view of a second embodiment with a user mounted on the machine in the at rest position illustrating the slidable upper and lower body user supports connected via a two-cable and multiple pulley system. FIG. 6 is a side view of this second embodiment with the machine in the at rest position illustrating the slidable upper and lower body user supports connected via a two-cable and multiple pulley system. FIG. 7 is a side view of this second embodiment with a user mounted on the machine in the activated position illustrating the slidable upper and lower body user supports connected via a two-cable and multiple pulley system. FIG. 8 is a side view of this second embodiment with the machine in the activated position illustrating the slidable upper and lower body user supports connected via a two-cable and multiple pulley system.

Figure 9:
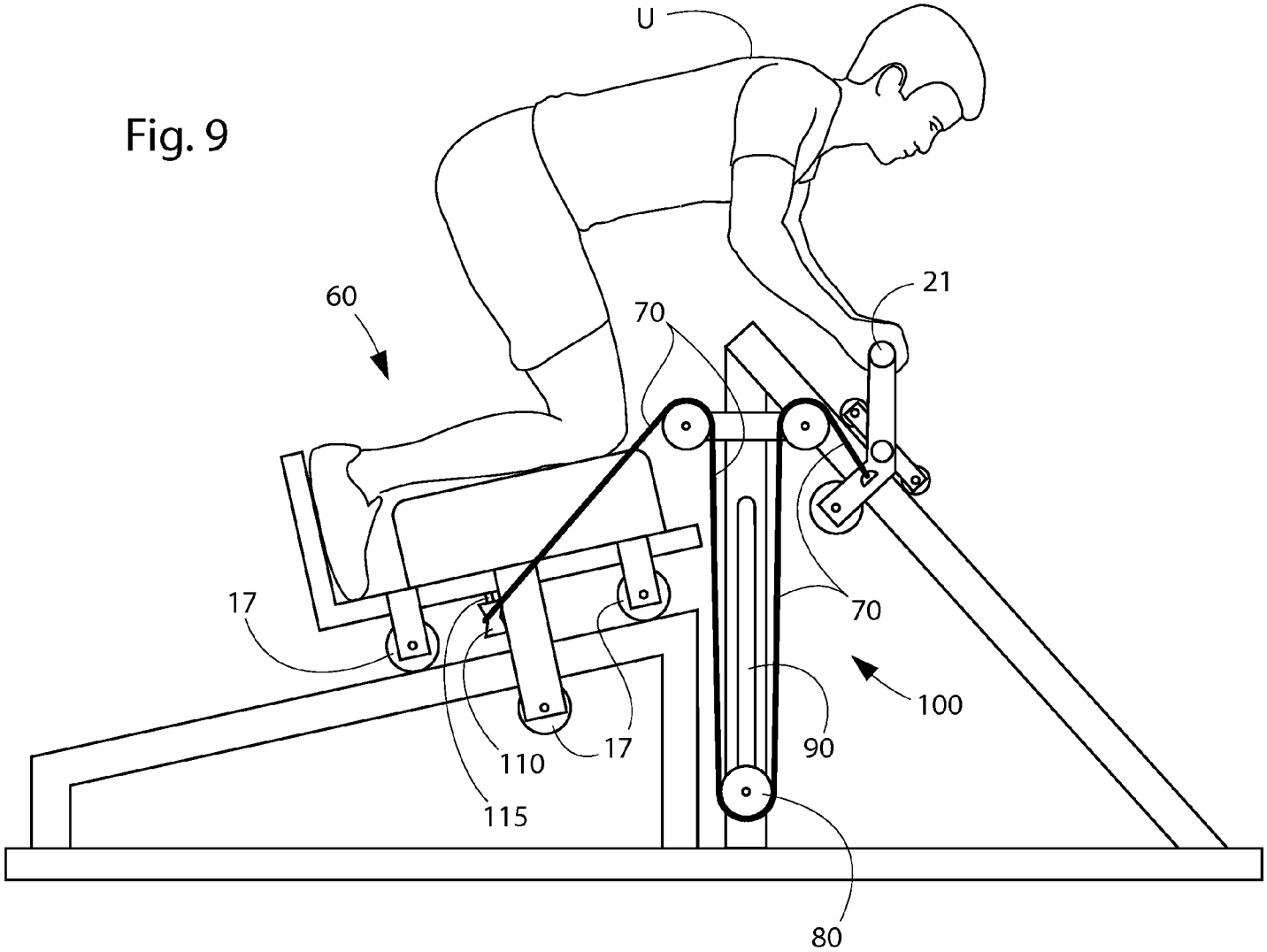
FIG. 9 is a side view of a third embodiment of the invention in the at rest and unactivated position showing a user mounted on the machine configured as a combination of a slidable lower body user support and a slidable upper body user support operatively connected via a single cable and multiple pulley system.
Figure 10:
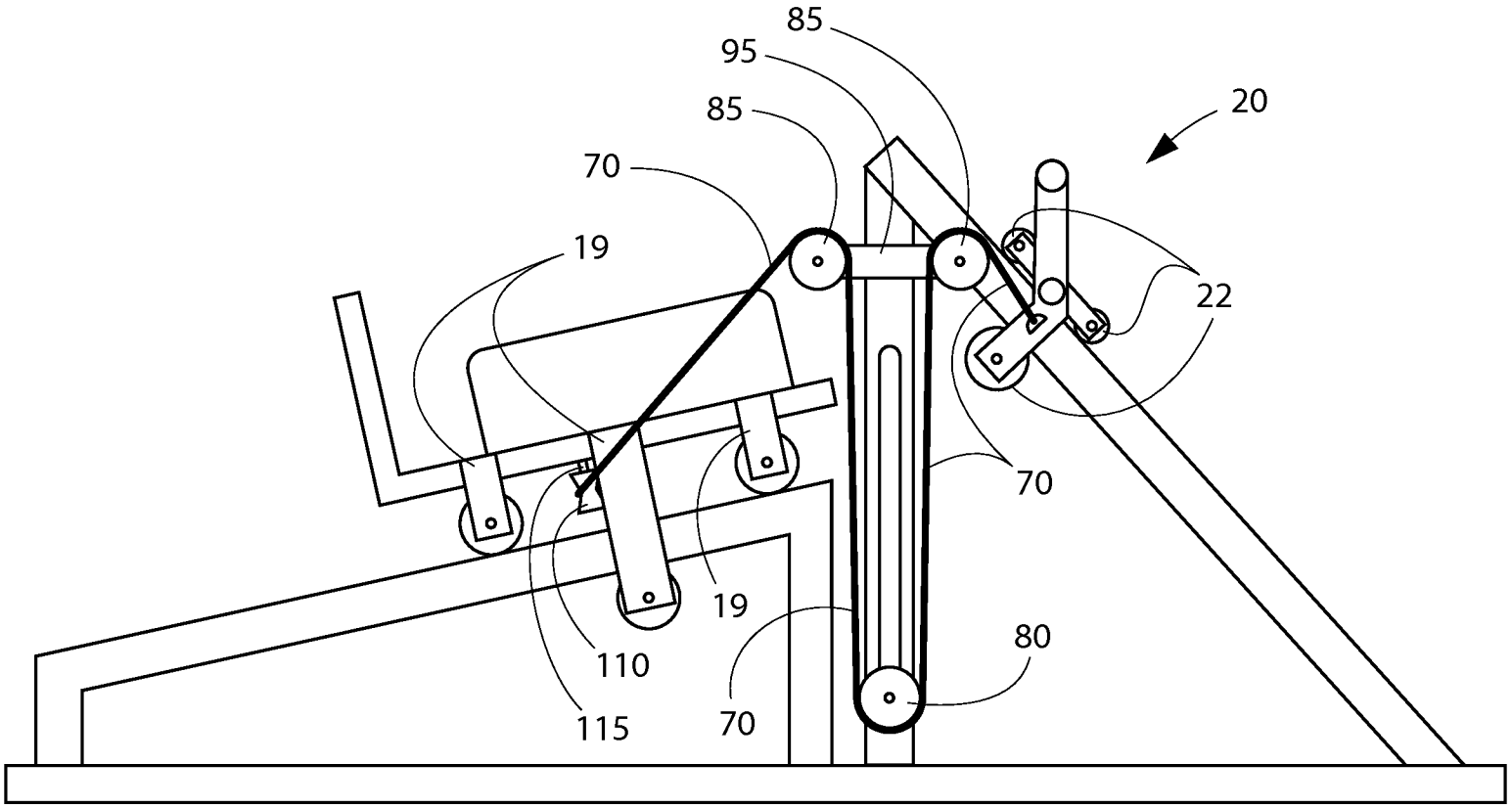
FIG. 10 is a side view of a third embodiment of the invention in the at rest and unactivated position configured as a combination of a slidable lower body user support and a slidable upper body user support operatively connected via a single cable and multiple pulley system.
Figure 11:
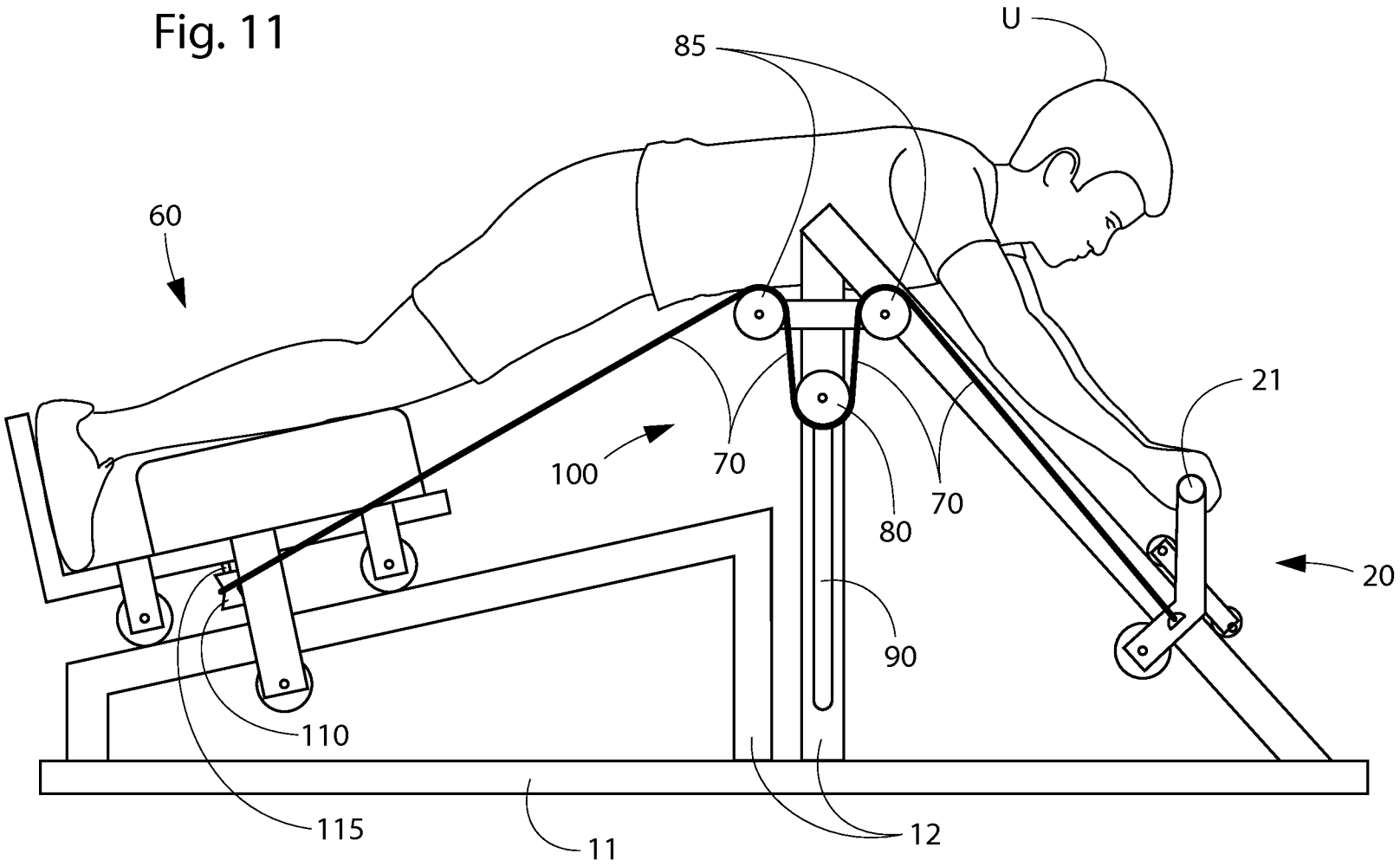
FIG. 11 is a side view of a third embodiment of the invention in the extended and activated position showing a user mounted on the machine configured as a combination of a slidable lower body user support and a slidable upper body user support operatively connected via a single cable and multiple pulley system.
Figure 12:
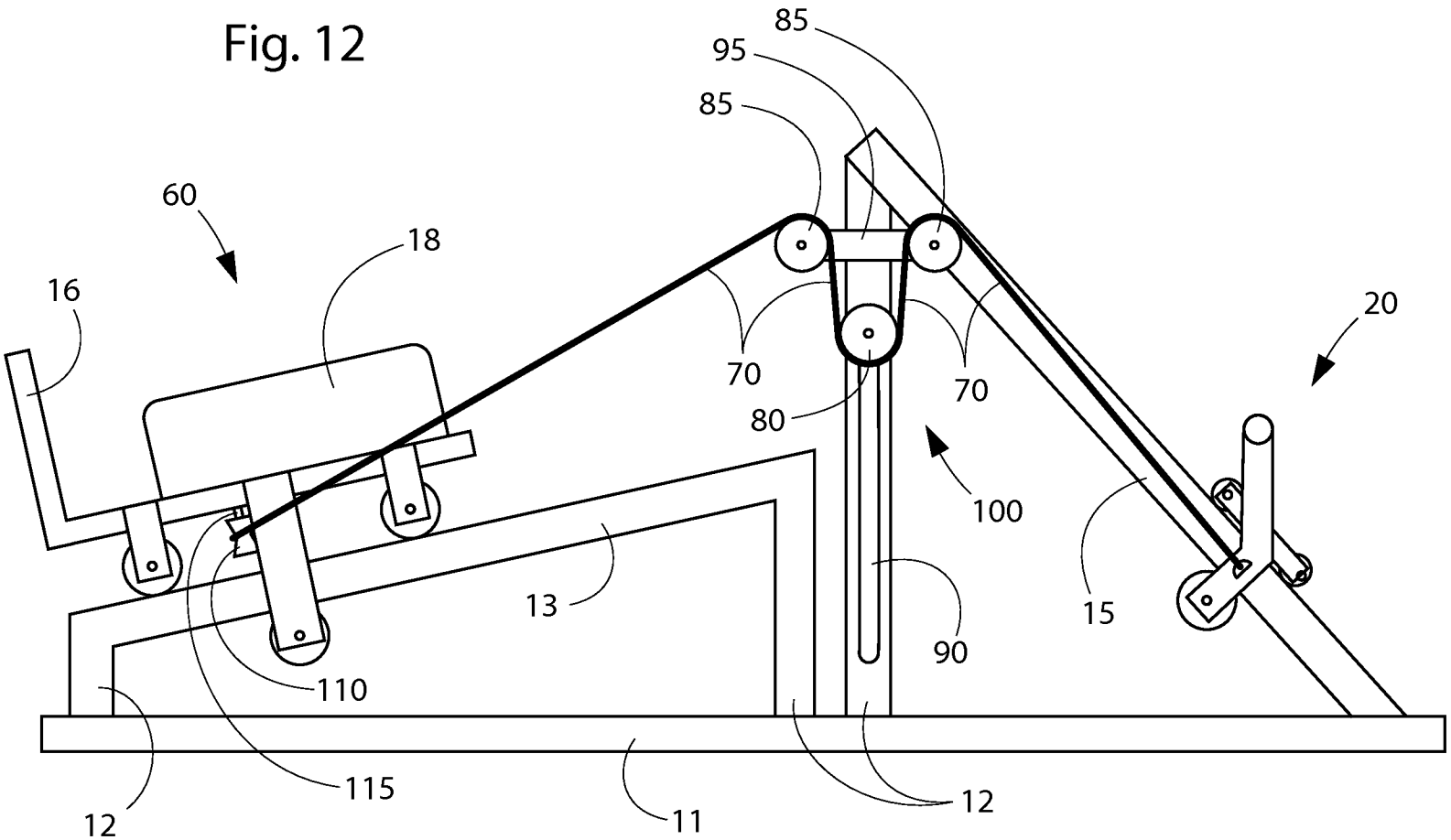
FIG. 12 is a side view of a third embodiment of the invention in the extended and activated position configured as a combination of a slidable lower body user support and a slidable upper body user support operatively connected via a single cable and multiple pulley system.

FIG. 9 is a side view of a third embodiment with a user mounted on the machine in the at rest position illustrating the slidable upper and lower body user supports connected via a one-cable and multiple pulley system. FIG. 10 is a side view of this third embodiment with the machine in the at rest position illustrating the slidable upper and lower body user supports connected via a one-cable and multiple pulley system. FIG. 11 is a side view of this third embodiment with a user mounted on the machine in the activated position illustrating the slidable upper and lower body user supports connected via a one-cable and multiple pulley system. FIG. 12 is a side view of this third embodiment with the machine in the activated position illustrating the slidable upper and lower body user supports connected via a one-cable and multiple pulley system.

Referring now to FIGS. 1-12, various views of several embodiments of the machine 10 are shown to provide a more complete understanding of the invention. The machine 10 comprises a stationary base frame 11 supporting linear slide rails 13 and 15 and a lower body user support or supports 60, and an upper body user support or supports 20. Lower body user support 60 and upper body user support 20 are operatively connected by either a rotatable linkage system 40 (FIGS. 1-4) which is attached to a rotatable central axle 50 or cable and multiple pulley system 100 with a vertically sliding resistance pulley or pulleys 80 (FIGS. 5-12).

The base frame 11 can be any suitable base, such as a set of formed or shaped tubes or channels, preferably parallel, for supporting the working components of the machine 10. The base frame 11 comprises components such as tubes and stands so as to form a stable base adequate to stably support the remainder of the machine 10 and a user U, as well as being able to stably withstand the movement of the machine 10 during use.

The lower body user support 60 is slidably mounted on at least one slide rail 13, which is rigidly mounted to and supported by at least one slide rail support 12 which is rigidly connected to and supported by the base frame 11. Lower body user support 60 is structured and mounted on slide rail 13 such that the user U can kneel on the user support 60 while using the machine 10 and slide the lower body user support 60 towards or converging and away from or diverging relative to user support 20.

The upper body user support 20 is slidably mounted on at least one slide rail 15 which is rigidly mounted to and supported by the base frame 11. Upper body user support 20 is structured and mounted on slide rail 15 such that user U can grasp user support 20 and more specifically pressing handles 21 while using machine 10 and slide the upper body user support 20 towards or converging and away from or diverging relative to lower body user support 60.

Upper body user support 20 is slidably mounted on slide rail 15 such that the user U can grasp pressing handles 21 while using machine 10 and slidably move upper body user support relative to the user's torso and lower body user support 60. In certain embodiments such as those illustrated in FIGS. 1-4, upper body user support 20 is operatively connected to lower body user support 60 via linkage system 40 such that upper body user support 20 and lower body user support 60 cooperate with each other during the exercise regimen. In certain other embodiments such as those illustrated in FIGS. 5-12, upper body user support 20 is operatively connected to lower body user support 60 via cable and pulleys system 100 such that upper body user support 20 and lower body user support cooperate with each other during the exercise regimen. Upper body user support 20 comprises at least one pressing handle 21 of any ergonomically desirable shape, with circular being the most common.

Lower body user support 60 is a generally planar or "L"-shaped structure on which a user U kneels, sits and supports a user U, during the exercise regimen when using the machine 10. User support 60 is most commonly a simple rectangular or square structure similar to the seat of a chair. User support 60 also contains a padded structure 18 thereon for the additional comfort of a user U. User support 23 preferably is of a size, shape, and strength to comfortably or at least adequately support a user U thereon.

In certain embodiments such as those illustrated in FIGS. 1-4, lower body user support 60 is operatively connected to upper body user support 20 via linkage system 40 such that lower body user support 60 and upper body user support 20 cooperate with each other during the exercise regimen. In certain other embodiments such as those illustrated in FIGS. 5-12, lower body user support 60 is operatively connected to upper body user support 20 via cable and pulleys system 100 such that lower body user support 60 and upper body user support 20 cooperate with each other during the exercise regimen. Lower body user support 60 comprises at least one foot pressing plate 16 of any desirable shape such as curved or angled, with flat being the most common.

The machine 10 also can include two separate lower body user supports 60L and 60R and two separate upper body user supports 20L and 20R. In certain embodiments such as those illustrated in FIGS. 1-4, the machine 10 also can include two separate rotatable linkage systems 40L and 40R both of which are mounted on rotatable central axle 50. In certain other embodiments such as those illustrated in FIGS. 5-8, the machine 10 also can include two separate cable and pulleys operative connections 100L and 100R each of which are mounted on pulley mounting brackets 95L and 95R, respectively, each of which are mounted on linear slide rail support 12L and 12R, respectively, that supports linear slide rail 15L and 15R, respectively. In these embodiments lower body user support 60L and upper body user support 20L are operatively connected and independent of lower body user support 60*r* and upper body user support 20R. Likewise, in these embodiments lower body user support 60R and upper body user support 20R are operatively connected and independent of lower body user support 60L and upper body user support 20L. Alternatively or additionally, a locking/unlocking mechanism (not shown) allows the lower body user supports 60L and 60R to be locked together and cooperate as one unit. Alternatively or additionally, a locking/unlocking mechanism (not shown) allows the upper body user supports 20L and 20R to be locked together and cooperate as one unit.

In preferred embodiments the lower body user support 60 comprises wheel connection brackets 19 rigidly attached to the lower frame structure of lower body user support 60. Support wheels 17 are rollably mounted to connection brackets 19. Preferably, there are two or more sets of connection brackets 19 extending downward from lower body user support 60 with two or more sets of support wheels 17 rollably mounted to connection brackets 19. Support wheels 17 are rollably connected to linear slide rail 13 with at least two support wheels connected with one side of linear slide rail 13 and at least one other support wheel connected with an opposite side of linear slide 13. In this manner, lower body user support 60 is effectively secured onto linear slide rail 13 in a slidable manner.

In certain embodiments, such as the embodiment shown in FIGS. 1-4, lower body user support 60 also comprises at least one pivoting link connection 32 attached to the central lower portion of the lower body user support 60. Pivoting link connection 32 rotatably or pivotably connects lower body user support 60 to the second end 32 of connection link 31. Link 31 and linkage system 40 operatively connects or links the lower body user support 60 to upper body user support 20 in a manner such that the activation of the machine 10 by pressing and releasing on lower body user support 60 and upper body user support 20 causes the causes the lower body user support 60 and upper body user support 20 to slide in the manner disclosed herein.

In certain embodiments such as the embodiment shown in FIGS. 5-12, lower body user support 60 also comprises at least one cable anchor 72 or cable connection pulley 110 attached to the central lower portion of the lower body user support 60. Cable anchor 72 or cable connection pulley 110 connects lower body user body user support 60 to cable 70. Cable 70 and cable and pulleys connection system 100 connect lower body user support 60 to upper body user support 20 in a manner such that the activation of the machine 10 by pressing and releasing on lower body user support 60 and upper body user support 20 causes the lower body user support 60 and upper body user support 20 to slide in the manner disclosed herein.

In preferred embodiments, the user support 60 also can be adjustable in slope. For example, an adjustment mechanism (not shown) can be incorporated into knee pad 18 so that it can be raised, lowered, or tilted relative to another portion of the lower body user support 60 for the comfort of the user U or to achieve the desired exercise effect.

In preferred embodiments the upper body user support 20 comprises wheel connection brackets 55 rigidly attached to the lower frame structure of upper body user support 20. Support wheels 22 are rollably mounted to connection brackets 55. Preferably, there are two or more sets of connection brackets 55 configured in a "T" shape to the lower portion of upper body user support 20 with two or more sets of support wheels 17 rollably mounted to connection brackets 55. Support wheels 22 are rollably connected to linear slide rail 15 with at least two support wheels connected with one side of linear slide rail 15 and at least one other support wheel connected with an opposite side of linear slide 15. In this manner, upper body user support 20 is effectively secured onto linear slide rail 15 in a slidable manner.

In certain embodiments, such as the embodiment shown in FIGS. 1-4, upper body user support 20 also comprises at least one pivoting link connection 23 attached to the central portion of the upper body user support 20. Pivoting link connection 23 rotatably or pivotably connects upper body user support 20 to the second end 23 of connection link 24. Link 24 and linkage system 40 operatively connects or links the upper body user support 20 to lower body user support 60 in a manner such that the activation of the machine 10 by pressing and releasing on lower body user support 60 and upper body user support 20 causes the causes the lower body user support 60 and upper body user support 20 to slide in the manner disclosed herein.

In certain embodiments such as the embodiment shown in FIGS. 5-12, upper body user support 20 also comprises at least one cable anchor 71 connected to the central lower portion of the upper body user support 20. Cable anchor 71 connects upper body user body user support 20 to cable 70. Cable 70 and cable and pulleys connection system 100 connect upper body user support 20 to lower body user support 60 in a manner such that the activation of the machine 10 by pressing and releasing on lower body user support 60 and upper body user support 20 causes the lower body user support 60 and upper body user support 20 to slide in the manner disclosed herein.

In certain embodiments such as the embodiments shown in FIGS. 1-4, the operative connection system between the lower body user support 60 and the upper body user support 20 is a rotatable multi-link linkage system 40. Linkage system 40 consist of two upper elongated bar or rod like link members 24 and 26 and two lower elongated bar or rod like link members 29 and 31. Upper link bar 26 and lower link bar 29 are rigidly connected on opposing sides of rotatable central axle 50, which is supported by rotatable central axle support 14. Link bar 24 operatively connects linkage system 40 to upper body user support 20 and link bar 31 operatively connects linkage system 40 to lower body user support 60. Therefore, linkage system 40 and rotatable central axle 50 operatively connects or links the upper body user support 20 to lower body user support 60 in a manner such that the activation of the machine 10 by pressing and releasing on lower body user support 60 and upper body user support 20 causes the lower body user support 60 and upper body user support 20 to slide in the manner disclosed herein.

In certain embodiments of the invention such as illustrated in FIGS. 1-4, additional resistance can be applied to the exercise motion via the rotatable central axle 50. This additional resistance can be applied to the rotatable central axle in a variety of manners. For example an elongated rigid bar or rod like member (not illustrated) can be rigidly attached to the outer most portion of the rotatable central axle 50 and weight plates (not illustrated) can be loaded onto this elongated member distal to the rotatable central axle. Said elongated member can be attached to the axle at a location that will cause the weight plates to move in an upward arching motion during the pressing motion of the exercise regimen. Another example of adding resistance to the rotatable central axles to add a disk or cam (not illustrated) to the outer most portion of the axle. Said cam would have one end of a cable, belt, chain, lever or other suitable resistance transference component (not illustrated) operatively connected to it and the opposing end connected to an external resistance force (not illustrated). Said cam would be sufficient in circumference so that the resistance transference component would not completely travel the circumference of the cam during the pressing motion.

In certain embodiments such as the embodiments shown in FIGS. 5-12, the operative connection system between the lower body user support 60 and the upper body user support 20 is a cable and pulleys system 100. The cable and pulleys system 100 consists of either one or two cables 70 and at least one vertically slidable and rotatable resistance pulley 80 and at least two stationary rotatable pulleys 85.

In the two cable embodiment as illustrated in FIGS. 5-8, the two cables are in mirror identical configurations, one end of each cable 71 is anchored to the upper body user support 20 and the other end of each cable 72 is anchored to the lower body user support 60. The central upper portions of the cables are looped over the stationary pulleys 85 and the central lower portion of the cable is looped under the vertically slidable and rotatable resistance pulleys 80. In the at rest and unactivated position the cables are taut and will move the resistance pulleys 80 vertically on vertical slide rails 90 immediately when the machine is activated.

In the one cable configuration as illustrated in FIGS. 9-12, one end of cable 70 is anchored to cable anchor 71 on one outer side of the upper body user support 20 and the opposing end of cable 70 is anchored to cable anchor 71 on the opposing outer side of upper body user support 20. The central upper side portions of cable 70 are looped over stationary pulleys 85 and the central lower portion of the cable is looped under the vertically slidable and rotatable resistance pulleys 80. The rearward portion of the cable is looped around two somewhat horizontally oriented pulleys located one opposing sides of the lower central portion of the lower body user support 60. In the at rest and unactivated position the cable is taut and will move one or both of the resistance pulleys 80 vertically on vertical slide rail 90 immediately when the machine is activated.

Therefore, in both the two cable configuration and the one cable configuration, cable and pulleys system 100 operatively connects the upper body user support 20 to lower body user support 60 in a manner such that the activation of the machine 10 by pressing and releasing on lower body user support 60 and upper body user support 20 causes the lower body user support 60 and upper body user support 20 to slide in the manner disclosed herein.

In certain embodiments of the invention such as illustrated in FIGS. 5-12, additional resistance can be applied to the exercise motion via the vertically rails 90 and slidable and rotatable resistance pulleys 80. This additional resistance can be applied to the central resistance pulleys 80 in a variety of manners. For example a rod or peg like member (not illustrated) can be attached and extended outwardly from the central portion of the pulleys 80 so that weight plates (not illustrated) could be added and lifted vertically during the exercise motion. Another example of adding resistance to the resistance pulleys 80 would be to operatively connect a cable, belt, chain, lever or other suitable resistance transference component (not illustrated) to the central portion of the resistance pulleys 80 and connect the opposing end to an external resistance force (not illustrated).

The invention comprises a lower body user support 60 that is slidably attached to, or cooperates with, a first location on a sliding member, such as slide rail 13. The lower body user support 60 can be of multiple shapes and configurations to comfortably and effectively support the user U during the exercise regimen. The lower body user support 60 is a kneeling pad, such as lower body user support pad 18, sufficient in size to support an adult human's knees and shins. The lower body user support 60 can comprise a user support frame for holding the user support pad 18. The user support frame also can comprise or be attached to the foot platform 16. In all lower body user support embodiments, there may be adjustments to any of the components to fit the size of the user U.

The invention also comprises an upper body user support 20 that is slidably attached to, or cooperates with, a first location on a sliding member, such as slide rail 15. The upper body user support 20 can be of multiple shapes and configurations to comfortably and effectively support the user U during the exercise regimen. In most embodiments, the upper body user support 20 is a gripping handle such as pressing handle 21. However, there may be multiple grips and can be various shapes, sizes, lengths and connected to upper body user support at various angles and locations. In all upper body user support embodiments, there may be adjustments to any of the components to fit the size of the user U.

The lower body user support 60 and upper body user support 20 are operatively connected, such that during operation of the machine 10 the operative connection mechanism controls the location of the lower body user support 60 on the linear path defined by slide rail 13 and the location of upper body user support 20 on the linear path defined by slide rail 15. In certain embodiments, this connection mechanism can be a multi-link rotatable linkage system 40 that attaches to the lower body user support 60 on the lower end of the linkage system and to an upper body user support 20 on the opposite and upper end of the linkage system. In other embodiments, the connection mechanism can be a two cable and multiple pulleys connection system 100 that attaches to the lower body user support 60 on one lower end and to an upper body user support 20 on the opposite end. In other embodiments the connection mechanism can be a one cable and multiple pulleys connection system 100 that attaches to the lower body user support 60 on one lower end and to an upper body user support 20 on the opposite end.

In preferred embodiments, the user's hands engage an engagement means, such as pressing handle 21, and the user's feet engage an engagement means 16, which are both operatively connected to the main frame 11 to move the lower body user support 60 and upper body user support 20 during the exercise motion.

In preferred embodiments of the invention, as illustrated in FIGS. 1-12, the main frame 11 of the machine 10 is a mostly rectangular shape with a kneeling lower body user support 60 movable in a linear path mounted on a proximal rearward portion of the machine 10, and an upper body user engagement means 20 movable in a linear path mounted on a proximal forward portion of the machine 10. The lower body user support 60 and the upper body user support 20 are operatively linked via a rotating linkage system 40 or cable linkage system 100. The kneeling upper body user support 60 comprises a kneeling user support pad 18 for supporting the user's knees and shins.

A foot pressing platform 16 is attached to the rearward most portion of the lower body user support 60 such that the foot pressing platform 16 is attached to the portion of the user platform 23 most distal to upper body user support 20. The foot pressing platform 16 is an elongated platform sufficient in height to support the user's entire foot. The foot pressing platform 16 is attached at its longest opposite ends to the lower body user support frame at a location a few inches rearward from the lower body user support pad 18 such that the user's feet can comfortably fit in the cavern created between the foot pressing platform 16 and the kneeling lower body user support pad 18. The foot pressing platform 16 is mounted at approximately a 90 degree angle to the frame that supports the lower body user support kneeling pad 18. In this configuration, the user's lower legs are perpendicular to the foot pressing platform 16 when operating the machine 10.

The lower body user support 60 slidably cooperates with a linear slide rail section 13 at a location proximal to the rearward half portion of frame 11. For example, the lower body user support 60 can have support wheels 17 attached to the bottom of the lower body user support 60 via brackets 19, such that support wheels 17 engage with the slide rail 13 to allow the lower body user support to slide along the slide rail 13. Alternatively, bearings, low friction materials, or other sliding means can be substituted for wheels 17. The rearward portion of lower body user support 60 is attached at a rearward location to the linear slide rail 13 that is in a lower elevation position than the forward and opposite end of the lower body user support 60, thus causing the lower body user support 60 to slope upwards from back to front in the at rest position. The linear slide rail 13 is mounted on the main frame 11 via slide rail supports 12 with the rearward portion of the linear slide rail 13 being proximal to the rearward end of the main frame 11. The linear slide rail 13 extends from the rearward portion of the main frame 11 in a direction towards the upper body user support means 20 at a distance suitable for sufficient operation of the machine 10 for its intended purpose. The linear slide rail 13 is attached to the main frame 11 at a sloping linear angle such that the rearward most part of the linear slide rail 13 is at a lower elevation than the forward portion of the linear slide rail 13 that terminates closer to the center section of the machine 10.

The upper body user support 20 slidably cooperates with a linear slide rail section 15 at a location proximal to the forward half portion of frame 11. For example, the upper body user support 20 can have support wheels 22 attached to the bottom of the upper body user support 20 via brackets 55, such that support wheels 22 engage with the slide rail 15 to allow the upper body user support to slide along the slide rail 15. Alternatively, bearings, low friction materials, or other sliding means can be substituted for wheels 22. The rearward portion of upper body user support 20 is attached at a rearward location to the linear slide rail 15 that is in a higher elevation position than the forward and opposite end of the upper body user support 20, thus causing the upper body user support 60 to slope downwards from back to front. The linear slide rail 15 is mounted directly on the main frame 11 with the forward portion of the linear slide rail 15 being proximal to the forward end of the main frame 11. The linear slide rail 15 extends from the forward portion of the main frame 11 in a direction towards the lower body user support means 20 at a distance suitable for sufficient operation of the machine 10 for its intended purpose. The linear slide rail 15 is attached to the main frame 11 at a sloping linear angle such that the forward most part of the linear slide rail 13 is at a lower elevation than the rearward portion of the linear slide rail 13 that terminates closer to the center section of the machine 10.

The preferred operative connection mechanism of this invention is a multi-link linkage system having four links and a rotatable central axle. The first end 23 of the first link 24 pivotably connects to upper body user support 20 and the second end 25 of the first link 24 is pivotably connected to a first end of the second link 26. The second end 27 of the second link 26 is rigidly connected to the rotatable central axle 50. The first end 28 of the third link 29 is rigidly connected to the rotatable central axle 50 proximal to a location on the rotatable central axle opposite the location of the second end 27 of the second link 26. The third link 29 and the fourth link 31 is pivotably connected at pivot 30. The second end of the fourth link 31 is pivotably connected to the slidable lower body user support at pivot connection 32. The rotatable central axle 50 is located between the slidable upper body user support member 20 and the slidable lower body member 60 so as to allow for optimal operation of the linkage system and not to impede the user's motion or come into contact with the user during the exercise regimen.

This embodiment also can include adjustment means or mechanisms so as to allow the distance between the lower body user support 60 and the upper body user support 20 to be increased or decreased in the at rest position to fit the user U. This embodiment also can provide a resistance means for increasing the exertion of the exercise. The resistance means can be free weights loaded onto a lever connected to rotatable central axle 50 or other resistance means connected to rotatable central axle 50.

Prior to the operation of this embodiment, the user U can adjust the starting location of the lower body user support 60 relative to the upper body user support 20 to a comfortable exercise position. The user U then can load or select the desired amount of resistance.

During operation, the user U kneels on the lower body user support pad 18 and places their feet against the foot pressing platform 16, which is in the at rest position. The user U then grasps the pressing handle 21 located on the upper body user support 20 which is in the at rest position.

To begin the exercise, the user U pushes the upper body user pressing handle 21 with their hands and arms forward and away from the lower body user support 60 in a forward and downward linear motion while concurrently pressing the foot pressing platform 16 connected to the lower body user support 60 with their feet and legs rearward and downward and away from the upper body user support 20 in a linear motion. This activates the rotatable multi-link linkage system 40 such that the links 24, 26, 29, and 31 rotate forward around rotatable central axle 50. This concurrent motion causes the lower body user support 60 to slide rearward and downward on linear slide rail 13 and away from the upper body user support 20. Concurrently, this causes the upper body user support 20 to slide forward and downward on linear slide rail 15 and away from the lower body user support 60. When the user decreases or releases the pressing force with their hands on upper body user support 20 and with their feet on lower body user support 60, the resistance means connected to rotatable central axle 50 will act upon linkage system 40 concurrently causing lower body user support 60 to slide in a linear and uphill fashion to return to the at rest position and lower body user support 20 to slide in a linear and uphill fashion to return to the at rest position.

The user U can press the lower body user support foot pressing platform 16 and the upper body user pressing handle 21 part way or all the way to the fully activated position so as to have activated a substantial amount of upper and lower body muscle groups. The user U can repeat the pressing and releasing action a number of times so as to complete a set of exercises. As can be seen, the present invention can exercise many of the upper and lower body muscle groups concurrently thus giving the user a more complete workout in a shorter period of time.

In a first preferred embodiment, the operative connection between the slidable upper body user support 20 member and the slidable lower body user support 60 member is a multi-lever pivoting linkage system 40 rigidly connected to a rotatable central axle 50. Each linkage is similar to an elongated rod or bar having opposite first and second ends. The linkages may be of similar or varying lengths. A first end 23 of a first link 24 is pivotably connected to the slidable upper body user support 20 member and a second end 25 of the first link 24 is pivotably connected to a first end 25 of a second link 26. A second end 27 of the second link 26 is connected to the rotatable central axle 50. A first end 28 of a third link 29 is connected to the rotatable central axle 50 proximal to a location on the rotatable central axle 50 opposite the location of the second end 27 of the second link 26. A second end 30 of the third link 29 is pivotably connected to a first end 30 of a fourth link 31 and a second end 32 of the fourth link 31 is pivotably connected to the slidable lower body user support 60. The rotatable central axle 50 is located between the slidable upper body user support 20 member and the slidable lower body support 60 member so as to allow for optimal operation of the linkage system 40 and not to impede the user's motion or come into contact with the user U during the exercise regimen.

The linkage system 40 preferably is configured such that in the at rest position the slidable upper body user support 20 member and the slidable lower body user support 60 member are located closer together, wherein the first and second links 24, 26 form a "V" shape where the wide ends of the "V" are the first end 23 of the first link 24 and the second end 27 of the second link 26. In the at rest position the third and fourth links 29, 31 also form a "V" shape where the wide ends of the "V" are the first end 28 of the third link 29 and the second end 32 of the fourth link 31. In the at rest position the first and second links 24, 26 are located proximally opposite of each of the third and fourth links 29, 31 so as to form somewhat of a "Z" shape with the rotatable central axle 50 being located proximal to the center of the "Z". In the fully activated position of the linkage mechanism 40 the slidable upper body user support 20 member and slidable lower body user support 60 member are farther apart, and the first and second links 24. 26 create a wider more diverged "V" shape and may be more of a linear shape. Also in the fully activated position the third and fourth links 29, 31 form a wider diverging "V" shape and may be of a more linear shape. In the fully activated position the first and second links 24, 26 are located proximally opposite to the third and fourth links 29, 31 so as to form an elongated "Z" or more linear shape with the rotatable central axle 50 being located proximal to the center of the elongated "Z" shape or more linear shape.

To operate this first preferred embodiment, the user enters the machine 10 and assumes a kneeling position on the slidable lower body user support 60 member with their feet against the foot pressing plate 16. The user U grasps the pressing handle 21 located on the slidable upper body user support 20 while the machine 10 is in the at rest or unactivated position. In this at rest or unactivated position, the user's feet and hands are closer together with the user's arms and legs in a more contracted position. To activate the machine 10 the user simultaneously presses the foot pressing plate 16 with their feet while pressing the upper body user pressing handle 21 with their hands, causing the linkage system 40 to rotate such that the first end 23 of the first link 24 which is pivotably connected to the slidable upper body user support 20 member moves forward and downward, causing the second end 25 of the first link 24 and the first end 25 of the second link 26 to rotate forward and away from the slidable lower body user support 60, thus causing the second end 27 of the second link 26, which is connected to the rotatable central axle 50, to rotate on the rotatable central axle 50. This rotation of the rotatable central axle 50 causes the first end 28 of the third link 29, which is connected to the rotatable central axle 50, to rotate, causing the second end 30 of the third link 29 and the first end 30 of the fourth link 31 to rotate rearward and away from the slidable upper body user support 20, thus causing the second end 32 of the fourth link 31, which is pivotably connected to the slidable lower body user support 60, to move rearward and away from the slidable upper body user support 20, thus sliding the lower body user support 60 member and the upper body user support 20 member in approximate opposite or diverging directions. The result is that the user U concurrently performs a leg pressing motion and an arm pressing motion in which the user's legs and arms extend.

The user may push the foot platform 16 and the pressing handle(s) 21 part of the way or to the fully extended position. After the user U has pressed the foot plate 16 and the pressing handle(s) 21 part of the way or to the fully extended position so as to have conducted the concurrent upper and lower body press motion, the user U can keep the pressing foot plate 16 and pressing handle(s) 21 in the activated position for additional exertion of the legs, arms and torso. The user U then can release the pressing motion on the foot pressing plate 16 and the pressing handle(s) 21 to allow the foot pressing plate 16 and pressing handle(s) 21 to the move in the opposite converging direction where the slidable lower body user support 60 and the slidable upper body user support 20 move closer together. This movement causes the second end 32 of the fourth link 31, which is pivotably attached to the lower body user support 60, to move in a forward direction, causing the first end 30 of the fourth link 31 and the second end 30 of the third link 29 to rotate forward and towards the upper body user support 20. This in turn causes the first end 28 of the third link 29, which is connected to the rotatable central axle 50, to rotate on the rotatable central axle 50. This rotation of the rotatable central axle 50 causes the second end 27 of the second link 26, which is connected to the rotatable central axle 50, to rotate on the rotatable central axle 50, causing the first end 25 of the second link 26 and the second end 25 of the first link 24 to move rearward and toward the lower body user support 60. This in turn causes the first end 23 of the first link 24, which is pivotably connected to the upper body user support 20, to move upward, rearward, and closer to the lower body user support 60 and closer to the at rest or unactivated position.

Additionally, when the user U presses and releases the foot pressing plate 16 and concurrently presses and releases the pressing handles 21, the user U is contracting and releasing multiple sets of muscle groups of the arms, legs and torso simultaneously. The user U can repeat the pressing and releasing motion a number of times so as to complete a set of exercises. As can be seen, this first preferred embodiment of the present invention can concurrently exercise many of the user's upper and lower body muscle groups, thus giving the user a more complete workout in a shorter amount of time.

In a second preferred embodiment, there are two separate slidable upper body user support 20 members, one for each of the user's arms, two separate slidable lower body user support 60 members, one for each of the user's legs, and two independent multi-link linkage systems 40 resulting in two independent exercise apparatuses contained within this embodiment of the invention. Each identical left and right independent exercise apparatus consists of one of the slidable upper body user support 20 members and one of the slidable lower body user support 60 members, which are operatively connected by one multi-link linkage system 40 to independently exercise a combination of one of the user's arms and one of the user's legs concurrently. Each link 24 26, 29, 31 is similar to an elongated rod or bar having opposite first and second ends, and the links 24 26, 29, 31 may be of similar or varying lengths.

For each independent linkage system 40, there is a first end 23 of a first link 24 that is pivotably connected to one of the slidable upper body user support 20 members and the second end 25 of the first link 24 is pivotably connected to a first end 25 of a second link 26. The second end 27 of the second link 26 is connected to the rotatable central axle 50. The first end 28 of a third link 29 is connected to the rotatable central axle 50 proximal to a location on the rotatable central axle 50 opposite the location of the second end 27 of the second link 26. The second end 30 of the third link 29 is pivotably connected to a first end 30 of a fourth link 31 and the second end 32 of the fourth link 31 is pivotably connected to one of the slidable lower body user support 60 members. The rotatable central axle 50 is located between one of the slidable upper body user support 20 members and the slidable lower body user support 60 members so as to allow for optimal operation of the linkage system 40 and not to impede the user's motion or come into contact with the user during the exercise regimen.

Both of the independent multi-link pivoting linkage systems 40 are rigidly connected to a rotatable central axle 50. Both of the independent linkage systems 40 are configured such that in the at rest position both of the slidable upper body user support 20 members are located closer to both of the slidable lower body user support 60 members and, on both sets of linkages 40, the first link 24 and the second link 26 form a "V" shape where the wide ends of the "V" are the first end 23 of the first link 24 and second end 27 of the second link 26. Also in the at rest position both sets of linkages 40 are configured such that the third link 29 and the fourth link 31 also form a "V" shape where the wide ends of the "V" are the first end 28 of the third link 29 and the second end 32 of the fourth link 31. In this at rest position, the first link 24 and the second link 26 are located proximally opposite of the third link 29 and the fourth link 31 so as to form somewhat of a "Z" shape with the rotatable central axle 50 being located proximal to the center of the "Z". In the fully activated position of the linkage mechanisms 40 the slidable upper body user support 20 members and the slidable lower body user support 60 members are farther apart, where the first link 24 and the second link 26 create a wider more diverged "V" shape and may be more of a linear shape. Also in the fully activated position the third link 29 and the fourth link 31 form a wider diverging "V" shape and may be of a more linear shape. In the fully activated positions the first link 24 and the second link 26 are located proximally opposite to the third link 29 and the fourth link 31 so as to form an elongated "Z" or more linear shape with the rotatable central axle 50 being located proximal to the center of the elongated "Z" shape or more linear shape.

In this second preferred embodiment, the rotatable central axle 50 can operate in two optional modes. In the "independent or unlocked" mode the left and right linkage systems 40 can rotate freely on the rotatable central axle 50 independent of one another. In the "dependent or locked" mode the left and right linkage systems 40 are locked together through the rotatable central axle 50 and will only rotate in unison. This locking and unlocking device for the rotatable central axle 50 may consist of many known devices including pins, levers, gears, couplings, and the like.

To operate this second preferred embodiment, the user U enters the machine 10 and assumes a kneeling position on each of the two slidable lower body user support 60 members with one foot against the foot pressing plate 16 of each lower body user support 60. The user U grasps the two separate pressing handles 21 located on each of the two slidable upper body user supports 20 while the machine 10 is in the at rest or unactivated position. In this at rest or unactivated position the user's feet and hands are closer together with the user's arms and legs in a more contracted position. To activate the machine 10 the user U presses the left foot pressing plate 16 with their left foot while concurrently pressing the left upper body user pressing handle 21 with their left hand and/or presses the right foot pressing plate 16 with their right foot while concurrently pressing the right upper body user pressing handle 21 with their right hand. Either or both of these actions will cause one or both of the independent linkage systems 40 to rotate such that the first end 23 of the first link 24, which is pivotably connected to the slidable upper body user support member(s) 20, moves forward and downward causing the second end 25 of the first link 24 and the first end 25 of the second link 26 to rotate forward and away from the slidable lower body user support(s) 60, thus causing the second end 27 of the second link 26, which is connected to the rotatable central axle 50, to rotate on the rotatable central axle 50. This rotation of the rotatable central axle 50 causes the first end 28 of the third link 29, which is connected to the rotatable central axle 50, to rotate causing the second end 30 of the third link 29 and the first end 30 of the fourth link 31 to rotate rearward and away from the slidable upper body user support(s) 20, thus causing the second end 32 of the fourth link 31, which is pivotably connected to the slidable lower body user support(s) 60, to move rearward and away from the slidable upper body user support(s) 20, thus sliding the lower body user support member(s) 60 and the upper body user support member(s) 20 in approximately opposite or diverging directions. The result is that the user U concurrently performs a left leg pressing motion with a left arm pressing motion and/or concurrently performs a right leg pressing motion with a right arm pressing motion. Whether the user U performs the exercise using one arm and one leg concurrently or two arms and two legs concurrently, either of these motions will cause the user's legs and arms to extend.

The user U may push the foot platform(s) 16 and the pressing handle(s) 21 part of the way or to the fully extended position. After the user U has pressed the foot plate(s) 16 and the pressing handle(s) 21 part of the way or to the fully extended position so as to have conducted the concurrent upper and lower body press motion(s), the user U can keep the pressing foot plate(s) 16 and pressing handle(s) 21 in the activated position for additional exertion of the legs, arms and torso. The user U then can release the pressing motion on the foot pressing plate(s) 16 and the pressing handle(s) 21 to allow the foot pressing plate(s) 16 and pressing handle(s) 21 to the move in the opposite converging direction where the slidable lower body user support(s) 60 and the slidable upper body user support(s) 20 move closer together. This movement causes either of the linkages systems 40 to move as follows: the second end 32 of the fourth link 31 that is pivotably attached to the lower body user support 60 moves in a forward direction, causing the first end 30 of the fourth link 31 and the second end 30 of the third link 29 to rotate forward and towards the upper body user support 20. This causes the first end 28 of the third link 29, which is connected to the rotatable central axle 50, to rotate on the rotatable central axle 50. This rotation of the rotatable central axle 50 causes the second end 27 of the second link 26, which is connected to the rotatable central axle 50, to rotate on the rotatable central axle 50, causing the first end 25 of the second link 26 and the second end 25 of the first link 24 to move rearward and toward the lower body user support 60. This causes the first end 23 of the first link 24, which is pivotably connected to the upper body user support 20, to move upward, rearward, and closer to the lower body user support 60 and closer to the at rest or unactivated position.

Additionally when the user U presses and releases the foot pressing plate(s) 16 and concurrently presses and releases the pressing handle(s) 21, the user U is contracting and releasing multiple sets of muscle groups of the arms, legs and torso simultaneously. The user U can repeat the pressing and releasing motion(s) a number of times so as to complete a set of exercises. As can be seen, this second preferred embodiment of the present invention can concurrently exercise many of the left side of the user's upper and lower body muscle groups or the right side of many of the user's upper and lower body muscle groups, or concurrently exercise both the right side and left side of the user's upper and lower body muscle groups, thus giving the user a more diverse and complete workout in a shorter amount of time.

In a third preferred embodiment of the invention, the slidable lower body user support 60 and the slidable upper body user support 20 are operatively connected by a cable or cables and pulleys system 100. In a two cable operating system of this third preferred embodiment, the two cables 70 are configured exactly the same in mirror configurations of each other on either side of the machine 10 as follows: a first end of the cable 70 is anchored (anchor 71) to the outer side of the slidable upper body user support 20. The cable configuration then moves upward and slightly rearward along the slide rail 15 of the upper body user support 20 and loops around a fixed rotatable first pulley 85 located near the top of the stationary frame 11, and then travels downward and loops around a vertically slidable and rotatable resistance second pulley 80 that is located near the lower central part of the frame 11. The cable 70 then travels proximally vertically upwards towards the top of the stationary frame 11 and loops around a third pulley 85 that is located proximal in height to the first pulley 85, and then the cable 70 travels downward and rearward and terminates on a lower central portion (anchor 72) of the sliding lower body user support 60. In the at rest position, the cable configuration 100 is a somewhat "M" shape where the center point of the M is longer than the outer legs of the M. In the fully activated position, the cable configuration 100 is a modified "M" shape where the center point of the M is shorter than the outer legs of the M.

To operate this third preferred embodiment, the user U enters the machine 10 and assumes a kneeling position on the slidable lower body user support member 60 with their feet against the foot pressing plate 16 and grasps the pressing handle 21 located on the slidable upper body user support 20 while the machine 10 is in the at rest or unactivated position. In this at rest or unactivated position, the user's feet and hands are closer together with the user's arms and legs in a more contracted position. To activate the machine 10, the user simultaneously presses the foot pressing plate 16 with their feet while pressing the upper body user pressing handle 21 with their hands causing the upper body user support 20 to move in a forward and downward motion and away from the lower body user support 60. Concurrently the lower body user support 60 moves rearward and away from the upper body user support 20 such that the lower body user support 60 and the upper body user support 10 move in approximately opposite and divergent directions. These actions cause the cables 70 to extend and act upon the centrally located vertically slidable rotatable resistance pulleys 80, thus causing these vertically slidable resistance pulleys 80 to move upward in a vertical motion. The result is that the user U concurrently performs a leg pressing motion and an arm pressing motion in which the user's legs and arms extend.

The user U may push the foot platform 16 and the pressing handle(s) 21 part of the way or to the fully extended position. In the fully extended position, the cables 70 configuration on both sides of the machine 10 resembles a modified "M" shape where the center point of the M is shorter and the outer legs are elongated. After the user U has pressed the foot plate 16 and the pressing handle(s) 21 part of the way or to the fully extended position so as to have conducted the concurrent upper and lower body press motion, the user U can keep the pressing foot plate 16 and pressing handle(s) 21 in the activated position for additional exertion of the legs, arms and torso. The user U then can release the pressing motion on the foot pressing plate 16 and the pressing handle 21 to allow the foot pressing plate 16 and pressing handle 21 to the move in the opposite converging direction where the slidable lower body user support 60 and the slidable upper body user support 20 move closer together. As the lower body user support 60 and the upper body user support 20 move towards each other the resistance on the vertically slidable and rotatable resistance pulleys 80 causes it to move downward in a vertical direction contracting the cables 70 back towards the at rest or unactivated position.

Additionally, when the user U presses and releases the foot pressing plate 16 and concurrently presses and releases the pressing handles 21, the user U is contracting and releasing multiple sets of muscle groups of the arms, legs and torso simultaneously. The user U can repeat the pressing and releasing motion a number of times so as to complete a set of exercises. As can be seen, this third preferred embodiment of the present invention can concurrently exercise many of the user's upper and lower body muscle groups thus giving the user a more complete workout in a shorter amount of time.

In a fourth preferred embodiment of the invention, there are two separate and independent upper body user support slidable members 20 and two separate and independent lower body user support 60 slidable members, and the operative connection between the four slidable independent user support members 20, 60 is a cable and pulleys system 100 configured such that in the at rest and unactivated position a first end of the cable 70 is anchored (first anchor 71) to the outer side of frame of the first slidable upper body user support 20. The cable configuration 100 then moves upward and rearward along the slide rail 15 of the first upper body user support 20 and loops around a first fixed rotatable pulley 85 located near the top of the stationary frame 11 and then travels downward and loops around a lower vertically slidable and rotatable second resistance pulley 80 that is located near the central portion of the frame 11. The cable 70 then travels upwards towards the top of the stationary frame 11 and loops around a third pulley 85 that is located proximal in height to the first pulley 85, and then travels downward and rearward toward to lower portion of the first slidable lower body user support 60. The cable then loops around a fourth pulley 110 mounted to the lower central portion of the first slidable lower body user support 60, and then travels beneath the first knee pad 18 of the lower body user support 60 in a perpendicular direction to a user's lower legs, and then loops around a fifth pulley 110 located on the lower central portion of the second slidable lower body user support 60. The cable 70 then travels upwards and forwards to loop around a sixth pulley 85 located in the opposite location of the third pulley 85, and then travels downwards and loops around a seventh vertically slidable and rotatable resistance pulley 80 located in a central portion of the frame 11 in the opposite location of the second pulley 80. The cable 70 then travels upwards and loops around an eighth pulley 85 located in the opposite location of the first pulley 85, and then travels downward and forward and terminates on the second slidable upper body user support 20 at second anchor 71. In this embodiment, the at rest position or unactivated position of the cable configuration 100 is identical on both sides of the machine 10 and resembles a modified "M" shape where the center point of the M is longer than the outer legs of the M. When any of the four independent slidable user supports 20, 60 are active independently or in combination with any of the other slidable user supports 20, 60, the cable configuration 100 may take on various shapes based on the location of the slidable user supports 20, 60.

An additional feature of this fourth preferred embodiment is that the two separate slidable lower body user support 60 members can be locked together such that they operate as a single member. Also, the two separate slidable upper body user support 20 members can be locked together such that they operate as a single member. This locking and unlocking feature of the user supports 20, 60 allows the user U to operate the machine 10 with four independent motions or three independent motions or two independent motions based on which of the user supports 20, 60 is locked together or allowed to operate independently. This locking and unlocking device may consist of many known devices including pins, levers, gears, couplings, and the like.

To operate this fourth preferred embodiment, the user U enters the machine 10 and assumes a kneeling position on the two separate slidable lower body user support 60 members with their feet against the foot pressing plates 16 and grasps the two separate pressing handles 21 located on the slidable upper body user supports 20 while the machine 10 is in the at rest or unactivated position. In this at rest or unactivated position, the user's feet and hands are closer together with the user's arms and legs in a more contracted position. To activate the machine 10 the user U presses any combination of one, two, three, or four of the four separate user support members 20, 60 causing any activated user support member 20, 60 to move away from the at rest position. This action will cause the vertically slidable rotatable resistance pulley 80 that is located on the same side of the machine 10 of any user support member 20, 60 that is activated to move vertically as the cable 70 on that side of the machine 10 is extended. If the user U activates one or more user support members 20, 60 on both sides of the machine 10 concurrently, the cable 70 will be extended on both sides of the machine 10 concurrently causing the vertically slidable and rotatable resistance pulleys 80 on both sides of the machine 10 to move in a vertical upward direction. The result of the user U activating any combination of the four user supports 20, 60 is that the user U will be performing an arm pressing motion by activating one or both of the upper body user supports 20 and will be performing a leg pressing motion by activating one or both of the lower body user supports 60. Any combination of activating an upper body user support 20 and a lower body user support 60 will result in a concurrent upper and lower body pressing exercise in which one or both of the user's legs and arms extend.

The user U may press any of the four user supports 20, 60 part of the way or to the fully extended position. When any of the user supports 20, 60 is activated, the cable configuration 100 on the side of the machine 10 where the user support 20, 60 is activated will resemble a modified "M" shape where the center point of the M is shorter and at least one of the outer legs will be more elongated. After the user U has pressed any combination of user supports 20, 60 part of the way or to the fully extended position so as to have conducted a lower and or upper body pressing motion(s), the user U can keep the combination of activated user supports 20, 60 in the activated position for additional exertion of the legs and or arms and torso. The user U then can release the pressing motion on any of the activated user supports 20, 60, allowing the user supports 20, 60 to move in a direction towards the at rest and unactivated position. As any of the user supports 20, 60 move in a direction towards the at rest and unactivated position, the resistance on the vertically slidable and rotatable resistance pulley 80 on the same side of any user support 20, 60 that moves in a direction towards the at rest and unactivated position will cause the vertically slidable and rotatable resistance pulley 80 to move downward in a vertical direction contracting the portion of the cable 70 on that side of the machine 10 back towards the at rest or unactivated position.

Additionally, when the user U presses and releases any combination of the user supports 20, 60, the user U is contracting and releasing one or more sets of muscle groups of the arms and or legs and torso. If two or more of the user supports 20, 60 are pressed and released concurrently, the user U is concurrently contracting and releasing two or more muscle groups of the arms and or legs and torso. The user U can repeat any combination of the pressing and releasing motions a number of times so as to complete a set of exercises. As can be seen, this fourth preferred embodiment of the present invention can independently or concurrently if desired exercise many of the user's upper and lower body muscle groups, thus providing an on demand diverse and dynamic exercise regimen.

Features and components of the preferred embodiments of the present invention include an operatively connected linear sliding lower body user support and a linear sliding upper body user support exercise machine for exercising in two planes of motion, the machine comprising, (a) a stationary main frame 11 having a front end and back end; (b) two or more stationary and parallel linear slide rails 13, 15 connected to or part of the main frame 11 that support at least two sliding or rolling user support 60, 20 traveling members; (c) a traveling member 60 engaging a second of the linear slide rail or rails 13 for movement in a fixed linear path along the linear slide rails 13 by the user feet; and (d) a traveling member 20 engaging a first of the linear slide rail or rails 15 for movement in a fixed linear path along the linear slide rails 15 by the user hands. Engagement by the user's hands and or feet causes the user supports 20, 60 to move in opposing converging and diverging linear paths along the linear slide rail or rails 15, 13. Engagement of the user supports 20, 60 activates the operative linkage system 40, 100, which locate the user supports 20, 60 along the linear slide rails 13, 15 during the exercise motion. In embodiments where there are two or more stationary and parallel linear slide rails 13, 15, such as (b) above, the at least two stationary linear slide rails 13, 15 are connected to opposite ends of the main frame 11, wherein the at least two stationary linear slide rails 13, 15 each comprise a longitudinal axis that are not parallel to each other. That is, the longitudinal axis of the first linear slide rail 15 is not parallel to the longitudinal axis of the second linear slide rail 13. For example, a first end of the first of the at least two stationary linear slide rails 15 is connected to the main frame 11 proximal to the front end of the main frame 11, a first end of the second of the at least two stationary linear slide rails 13 is connected to the main frame 11 proximal to the back end of the main frame 11, and a second end of the second of the at least two stationary linear slide rails 13 is connected to the main frame 11 proximal to the central section of the main frame 11, resulting in the longitudinal axis of the first linear slide rail 15 not being parallel to the longitudinal axis of the second linear slide rail 13.

Also in preferred embodiments, the lower body user support 60 and the upper body user support 20 can be movable between a first at rest position and a second fully activated position and can be maintained at any position between the first at rest position and the second fully activated position relative to one another as located by the operative linkage system 40, 100.

Also in preferred embodiments, resistance can be added to the exercise motion to increase the exertion of the exercise. The resistance can be selected from but not limited to free weights, weight stacks, hydraulic devices, pneumatic devices, brake-clutch devices, elastic devices, friction devices, springs, and moment arm devices. The amount of weight resistance can be controlled by the user U. For example, if the resistance mechanism comprises a free weight bar, additional weights can be added to or removed from the weight bar in a conventional manner. Other resistance mechanisms can be used in their conventional manners.

Each of the components of the invention can be adjustable so as to provide a comfortable and appropriate exercise regimen.

Preferred embodiments of the invention also can include an optional resistance or assistance mechanism that can be mounted on the invention at various alternative locations so long as the resistance or assistance mechanism is operatively connected to the invention so as to impart additional resistance or assistance to the user during the exercise regimen. The movement of the resistance or assistance mechanism relative to the links or cables can be directly or proportionally related to the movement of the link or cable, respectively. The degree of weight resistance of the resistance or assistance mechanism can be controlled by the user U. For example, if the resistance or assistance mechanism comprises a free weight bar, additional weights can be added to or removed from the weight bar in a conventional manner. Other resistance or assistance mechanisms can be used in their conventional manners.

The invention also can include adjustment means or mechanisms so as to allow the invention to be adjusted to fit the user U. Thus, each of the components of the invention is or can be adjustable so as to provide a comfortable and appropriate exercise regimen.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
10 Machine—Total Body Press
11 Main Frame
12 Slide Rail Support
13 Second Linear Slide Rail
14 Rotatable Central Axle support
15 First Linear Slide Rail
16 Foot Pressing Plate
17 Lower Body User Support Wheels
18 Lower Body User Support Pad
19 Lower Body User Support Connection Brackets
20 Upper Body User Support
21 Pressing Handle
22 Upper Body User Support Wheels
23 First End of Pivoting Link Bar 24
24 First Link Bar 24
25 Second End of Pivoting Link Bar 24/First End of Link Bar 26
26 Second Link Bar 26
27 Second End of Link Bar 26
28 First End of Link Bar 29
29 Third Link Bar 29
30 Second End of Link Bar 29/First End of Link Bar 31
31 Fourth Link Bar 31
32 Second End of Link Bar 31
40 Rotating Multi-Link Linkage System
50 Rotatable Central Axle
55 Upper Body User Support Connection Brackets
60 Lower Body User Support
70 Cable

71 Upper Body User Support Cable Anchor
72 Lower Body User Support Cable Anchor
80 Vertically Slidable and Rotatable Resistance Pulley
85 Stationary Rotatable Pulleys
90 Vertically Slidable and Rotatable Resistance Pulley Slide Rail
95 Stationary Pulley Mount Brackets
100 Cable and Pulleys Operative Connection
110 Horizontal Cable Pulley
115 Horizontal Cable Pulley Attachment Hardware

What is claimed is:

1. A concurrent upper body press and lower body press exercise machine comprising:

a) a stationary main frame having a front end, a back end, and a central section between the front end and the back end;

b) at least two stationary linear slide rails connected to opposite ends of the main frame, wherein the at least two stationary linear slide rails each comprise a longitudinal axis that are not parallel to each other, wherein a first end of a first of the at least two stationary linear slide rails is connected to the main frame proximal to the front end of the main frame, and wherein a first end of a second of the at least two stationary linear slide rails is connected to the main frame proximal to the back end of the main frame and a second end of the second of the at least two stationary linear slide rails is connected to the main frame proximal to the central section of the main frame;

c) at least two traveling members, each of which slides or rolls along a respective one of the at least two stationary linear slide rails for movement in a fixed linear path along the respective one of the at least two stationary linear slide rails;

d) a lower body user support, in the form of a kneeling lower leg support, comprising one of the at least two traveling members, whereby the lower body user support is slidably or rollably connected to the second of the at least two stationary linear slide rails;

e) a user engagement means, in the form of a foot pressing platform, connected to the lower body user support or for engagement by a user's feet while exercising;

f) an upper body user support comprising a user engagement means and another one of the at least two traveling members, whereby the upper body user support is slidably or rollably connected to the first of the at least two stationary linear slide rails;

g) the user engagement means, in the form of a pressing handle, connected to the upper body user support for engagement by the user's hands while exercising;

h) an operative connection mechanism connecting the upper body user support to the lower body user support, wherein the operative connection mechanism is a multi-link linkage system, and wherein the multi-link linkage system comprises a plurality of links, and at least one of the plurality of links is pivotably connected to the upper body user support and at least another one of the plurality of links is pivotably connected to the lower body user support; and i) a resistance component connected to the operative connection mechanism for concurrently imparting one directional resistance to pressing motions of the lower body user support and the upper body user support.

2. The exercise machine of claim 1, wherein the multi-link linkage system is rotatable around a rotatable central axle.

3. The exercise machine of claim 2, wherein the rotatable central axle is located between the upper body user support and the lower body user support.

4. The exercise machine of claim 3, wherein moving the lower body user support away from the upper body user support causes both the lower body user support and the upper body user support to move concurrently in diverging angular linear paths, and moving the lower body user support closer to the upper body user support causes both the lower body user support and the upper body user support to move concurrently in converging angular linear paths, during operation of the machine.

5. The exercise machine of claim 4, wherein a location of the lower body user support on the second of the at least two stationary linear slide rails dictates a location of the upper body user support on the first of the at least two stationary linear slide rails, and the location of the upper body user support on the first of the at least two stationary linear slide rails dictates the location of the lower body user support on the second of the at least two stationary linear slide rails.

6. The exercise machine of claim 5, wherein the upper body user support and the lower body user support are movable between a first at rest position and a second fully activated position and are maintainable at any position between the first at rest position and the second fully activated position.

7. The exercise machine of claim 6, wherein the first of the at least two stationary linear slide rails and the second of the at least two stationary linear slide rails are located proximally on opposing ends of the stationary main frame, and the upper body user support and the lower body user support cooperate with one another to move in opposing converging and diverging sloping linear movement patterns during operation of the machine.

* * * * *